US005555310A

United States Patent [19]

Minami et al.

[11] Patent Number: 5,555,310

[45] Date of Patent: Sep. 10, 1996

[54] STEREO VOICE TRANSMISSION APPARATUS, STEREO SIGNAL CODING/DECODING APPARATUS, ECHO CANCELER, AND VOICE INPUT/OUTPUT APPARATUS TO WHICH THIS ECHO CANCELER IS APPLIED

[75] Inventors: Shigenobu Minami, Ayase; Osamu Okada, Tokyo, both of Japan

[73] Assignee: Kabushiki Kaisha Toshiba, Kawasaki, Japan

[21] Appl. No.: 195,023

[22] Filed: Feb. 14, 1994

[30] Foreign Application Priority Data

| | | | |
|---|---|---|---|
| Feb. 12, 1993 | [JP] | Japan | 5-024051 |
| Feb. 26, 1993 | [JP] | Japan | 5-038908 |
| Mar. 12, 1993 | [JP] | Japan | 5-051189 |

[51] Int. Cl.[6] ..... H04H 5/00

[52] U.S. Cl. ..... 381/17; 381/66; 379/390

[58] Field of Search ..... 348/14, 15, 738; 379/388, 389, 390, 206; 381/66, 17

[56] References Cited

U.S. PATENT DOCUMENTS

| | | | |
|---|---|---|---|
| 4,069,395 | 1/1978 | Nash | 381/66 |
| 4,215,252 | 7/1980 | Onufry, Jr. | 381/66 |
| 4,792,974 | 12/1988 | Chace | 381/17 |
| 4,815,132 | 3/1989 | Minami . | |
| 4,965,822 | 10/1990 | Williams | 379/390 |
| 5,027,393 | 6/1991 | Yamamura et al. | 379/388 |
| 5,027,689 | 7/1991 | Fujimori | 84/622 |
| 5,033,082 | 7/1991 | Eriksson et al. | 379/388 |
| 5,164,840 | 11/1992 | Kawamura et al. | 381/17 |
| 5,212,733 | 5/1993 | DeVitt et al. | 381/119 |
| 5,291,556 | 3/1994 | Gale | 381/17 |
| 5,323,459 | 7/1994 | Hirano | 381/66 |

FOREIGN PATENT DOCUMENTS 62-051844 3/1987 Japan .

*Primary Examiner*—Forester W. Isen

*Attorney, Agent, or Firm*—Finnegan, Henderson, Farabow, Garrett & Dunner, L.L.P.

[57] ABSTRACT

According to this invention, a stereo voice transmission apparatus for coding and decoding voice signals input from a plurality of input units includes a discriminating means for discriminating a single utterance mode from a multiple simultaneous utterance mode, a first coding means for coding the voice signal when the discriminating means discriminates the single utterance mode, a first decoding means for decoding voice information coded by the first coding means, a plurality of second coding means, arranged in correspondence with the plurality of input units, for coding the voice signals when the discriminating means discriminates the multiple simultaneous utterance mode, and a plurality of second decoding means, arranged in correspondence with the plurality of second coding means, for decoding pieces of voice information respectively coded by the plurality of second coding means.

43 Claims, 13 Drawing Sheets

STEREO VOICE TRANSMISSION APPARATUS, STEREO SIGNAL CODING/DECODING APPARATUS, ECHO CANCELER, AND VOICE INPUT/OUTPUT APPARATUS TO WHICH THIS ECHO CANCELER IS APPLIED

BACKGROUND OF THE INVENTION

1. Field of the Invention

The present invention relates to a stereo voice transmission apparatus used in a remote conference system or the like, an echo canceler especially for a stereo voice, and a voice input/output apparatus to which this echo canceler is applied.

2. Description of the Related Art

In recent years, along with the developments of communication techniques, strong demand has arisen for a remote conference system through which a conference can be held between remote locations.

A remote conference system generally comprises an input/output system, a control system, and a transmission system to exchange image information such as motion and still images and voice information between the remote locations through a transmission line. The input/output system includes a microphone, a loudspeaker, a TV camera, a TV set, an electronic blackboard, a FAX machine, and a telewriting unit. The control system includes a voice unit, a control unit, a control pad, and an imaging unit. The transmission system includes the transmission line and a transmission unit. In a remote conference system, a decrease in transmission cost of information such as image information and voice information has been demanded. In particular, if these pieces of information can be transmitted at a transmission rate of about 64 kbps which allows transmission in an existing public subscriber line, a remote conference system at a lower cost than a high-quality remote conference system using optical fibers can be realized. In an ISDN (Integrated Service Digital Network) in which digitization has been completed to the level of end user, i.e., a public subscriber, the above transmission rate will serve as a factor for the solution of the problem on popularity of remote conference systems in applications ranging from medium-and-small-business use to home use.

In a remote conference system using a transmission line at a low transmission rate of, e.g., 64 kbps, a large volume of information such as images and voices must be compressed within a range which does not interfere with discussions in a conference. Even if a monaural voice must be compressed to a low transmission rate of about 16 kbps by voice data compression such as ADPC, a stereo voice is not generally used.

In a remote conference system, to enhance the effect of presence and discriminate a specific speaker who is currently talking to listeners, it is preferable to employ stereo voices.

A stereo voice transmission scheme capable of transmitting a high-quality stereo voice at low cost is known even in a transmission line having a low transmission rate (Jpn. Pat. Appln. KOKAI Application No. 62-51844).

In this stereo voice transmission scheme, main information representing a voice signal of at least one of a plurality of channels and additional information required to synthesize a voice signal of the remaining channel from the main information are coded, and the coded information is transmitted from a transmission side. On a reception side, the voice signal of each channel transmitted by the main channel is decoded and reproduced, and the voice signal of the remaining channel is reproduced by synthesizing the main information and the additional information.

This scheme will be described in detail with reference to FIG. 1.

As shown in FIG. 1, a voice $X(\omega)$ (where $\omega$ is the angular frequency) of a speaker $A_1$ is input to right- and left-channel microphones $\mathbf{101}_R$ and $\mathbf{101}_L$. In this case, echoes from a wall and the like are neglected. Left- and right-channel transfer functions are defined as $G_L(\omega)$ and $G_R(\omega)$, left- and right-channel input voices $Y_L(\omega)$ and $Y_R(\omega)$ are expressed as follows:

$$Y_L(\omega)=G_L(\omega) \cdot X(\omega) \quad (1)$$

$$Y_R(\omega)=G_R(\omega) \cdot X(\omega) \quad (2)$$

From equations (1) and (2), the following equations can be derived:

$$Y_L(\omega) = \{G_L(\omega)/G_R(\omega)\} \cdot Y_R(\omega) \quad (3)$$

$$= G(\omega) \cdot Y_R(\omega) \quad (4)$$

From equation (4), if the transfer function $G(\omega)$ is known, the right-channel voice can be reproduced. According to this scheme, therefore, in stereo voice transmission, the right- and left-channel voices are not independently transmitted. A voice signal of one channel, e.g., the right-channel voice signal $Y_R(\omega)$, and an estimated transfer function $G(\omega)$ are transmitted from the transmission side. The right-channel voice signal $Y_R(\omega)$ and the transfer function $G(\omega)$ which are received by the reception side are synthesized to obtain the left-channel voice signal $Y_L(\omega)$. Therefore, the right- and left-channel voices are reproduced at right- and left-channel loudspeakers $\mathbf{501}_R$ and $\mathbf{501}_L$, thereby transmitting the stereo voice.

According to the above scheme, if an utterance is a single utterance, the transfer function $G(\omega)$ can be defined by a simple delay and simple attenuation. The volume of information can be much smaller than that of the voice signal $Y_L(\omega)$, and estimation can be simply performed. Therefore, a stereo voice can be transmitted in a smaller transmission amount.

In the above system, since the single utterance is assumed, an accurate transfer function $G(\omega)$, i.e., additional information cannot be generated in a multiple simultaneous utterance mode, and a sound image localization fluctuates.

In a conversation as in a conference, a ratio of the multiple simultaneous utterance to the single utterance may be generally very low. In a conventional scheme, as described above, each single utterance is transmitted as a monaural voice to realize a high band compression ratio. However, monaural voice transmission is directly applied even in the multiple simultaneous utterance mode which is rarely set. Therefore, a sound image localization undesirably fluctuates.

In addition, in a remote conference system, a speaker on the other end of the line is displayed for a discussion in a conference. In this case, if a sound image localization is formed in correspondence with the position of a window on a screen, the sound image localization is effective for improving a natural effect and discrimination of a plurality of speakers. This sound image localization control is achieved such that delay and gain differences are given to voices of speakers on the other end of line, and the voices of these speakers are output from upper, lower, right, and left loudspeakers.

When a conference is held as described above, voices output from the loudspeakers may be input again to a microphone to cause echoing and howling. An echo canceler is effective to cancel echoing and howling.

Assume that the position of the window can be located at an arbitrary position on the screen. In this case, to cancel echoing and howling upon a change in window position, a sound image localization control unit for controlling the sound image localization must be located on an acoustic path side when viewed from the echo canceler. However, in this arrangement, when the window position changes, the sound image localization control unit and the echo canceler must relearn control and canceling, and a cancel amount undesirably decreases.

To solve the above problem, an echo canceler may be used for each loudspeaker. In this case, the echo cancelers must perform filtering of up to 4,000 stages (FIRAF). thereby greatly increasing the cost.

In a remote conference system, use of a stereo voice is desirable to improve the effect of presence. In this case, the output voices from the right and left loudspeakers are input to the right and left microphones through different echo paths. For this reason, four echo paths are present. A processing volume four times that of monaural voice processing is required for a stereo voice echo canceler.

FIG. 2 shows the arrangement of a conventional stereo voice echo canceler.

FIG. 2 shows only a right-channel microphone. If the same stereo voice echo canceler is used for the left-channel microphone, a stereo echo canceler for canceling echoes input from the right and left microphones can be realized.

Referring to FIG. 2, output voices from first and second loudspeakers $\mathbf{501}_1$ an $\mathbf{501}_2$ constituting the left and right loudspeakers are reflected by an obstacle 610 such as a wall or man and input as an echo signal component to a right-channel microphone 101.

At this time, the echo signal component is assumed to be generated through two echo paths $H_{RR}$ and $H_{LR}$.

As echo cancelers for canceling these echo components, first and second echo cancelers $\mathbf{600}_1$ and $\mathbf{600}_2$ for respectively estimating two pseudo echo paths $H'_{RR}$ and $H'_{LR}$ corresponding to the two echo paths $H_{RR}$ and $H_{LR}$ are required.

However, such an echo canceler must be realized using a filter having an impulse response of several hundreds of msec for one echo path when the number of echo paths is increased to two and then four, the circuit size increases to increase the cost.

SUMMARY OF THE INVENTION

It is an object of the present invention to provide a high-quality stereo voice transmission apparatus in which a sound image localization does not fluctuate even in a multiple simultaneous utterance mode.

It is another object of the present invention to provide a low-cost echo canceler which does not decrease a cancel amount of an acoustic echo and a low-cost echo canceler capable of canceling acoustic echoes from a plurality of echo paths.

A stereo voice transmission apparatus for coding and decoding voice signals input from a plurality of input units, according to the present invention is characterized by comprising: discriminating means for discriminating a single utterance mode from a multiple simultaneous utterance mode; first coding means for coding the voice signal when the discriminating means discriminates the single utterance mode; first decoding means for decoding voice information coded by the first coding means; a plurality of second coding means, arranged in correspondence with the plurality of input units, for coding the voice signals when the discriminating means discriminates the multiple simultaneous utterance mode, and a plurality of second decoding means, arranged in correspondence with the plurality of second coding means, for decoding pieces of voice information respectively coded by the plurality of second coding means.

The first coding means is characterized by including means for at least one of coding main information consisting of a voice signal of at least one of the plurality of input units and means for coding the voice signal with respect to a voice band wider than that of the second coding means and means for performing coding of the main information at a rate higher than that of coding of each of the plurality of second coding means.

The second coding means is characterized by including means for respectively coding voice signals output from the plurality of input units corresponding to the plurality of second coding means.

Other preferable embodiments are characterized in that (1) the first coding means includes means for coding the voice signal with respect to a voice band wider than that of the second coding means, (2) the first coding means includes means for coding the voice signal at a rate equal to or more than a code output rate of the second coding means, and (3) the first coding means and the plurality of second coding means respectively include means for variably changing code output rates.

An apparatus of the invention preferable further comprise selecting means for selecting coded main information and coded additional information in a single utterance mode and the pieces of coded voice information in a multiple simultaneous utterance mode or selecting means for selecting decoded main information and decoded additional information in a single utterance mode and the pieces of decoded voice information in a multiple simultaneous utterance mode.

According to the present invention, stereo voice transmission is performed in the multiple simultaneous utterance mode, and monaural voice transmission is performed in a single utterance mode, thereby preventing fluctuations of sound image localization. However, when stereo voice transmission is simply performed in the multiple simultaneous utterance mode, the transmission rate temporarily increases in the multiple simultaneous utterance mode. For this reason, the quality is slightly degraded in the multiple simultaneously utterance mode, and stereo voice transmission can be realized without increasing the transmission rate.

The present invention provides a coding scheme suitable for a transmission line using an Asynchronous Transfer Mode (ATM) capable of variably changing the transmission rate in accordance with the information volume of a signal source.

According to the stereo voice transmission apparatus of the present invention, stereo voice transmission is performed in the multiple simultaneous utterance mode, and the monaural voice transmission is performed in the single utterance mode, thereby preventing fluctuations of sound image localization and obtaining a high-quality stereo voice.

An echo canceler, applied to a voice input apparatus including a plurality of audible sound output units for outputting a plurality of audible sounds obtained such that sound image localization control of an input monaural voice signal is performed on the basis of a plurality of pieces of sound image localization control information using at least one of a delay difference, a phase difference, and a gain difference as information, and for forming a sound image localization at a position corresponding to a position of an image displayed on display means and an audible sound input unit for inputting an audible sound, for estimating acoustic echoes input from the plurality of audible sound output units to the audible sound input unit, on the basis of estimated synthetic echo path characteristics between the plurality of audible sound output units and the audible sound input unit, and for subtracting the acoustic echoes from an audible sound input to the audible sound input unit, according to the present invention is characterized by comprising: estimating means for estimating respective acoustic transfer characteristics between the plurality of audible sound output units and the audible sound input unit on the basis of present sound image localization control information, past sound image localization control information, a present estimated synthetic echo path characteristic, and a past estimated synthetic echo path characteristic; and generating means for, when the position of the image displayed on the screen changes, generating a new estimated synthetic echo path characteristic on the basis of the new sound image localization control information and the new acoustic transfer characteristics which correspond to the change in position.

The estimating means is characterized by including means for estimating the respective acoustic transfer characteristics between the plurality of audible sound output units and the audible sound input unit by linear arithmetic processing between the present sound image localization control information, the past sound image localization control information, the present estimated synthetic echo path characteristic, and the past estimated synthetic echo path characteristic, and further including means for performing the linear arithmetic processing by performing multiplication between an inverse matrix of a matrix having the present sound image localization control information and the past sound image localization control information as elements and a matrix having the present estimated synthetic echo path characteristic and the past estimated synthetic echo path characteristic as elements.

A voice input/output apparatus according the present invention is characterized by comprising: sound image localization control information generating means for generating a plurality of pieces of sound image localization control information using, as information, at least one of a delay difference, a phase difference, and a gain difference which are determined in correspondence with a position of an image displayed on a screen; a plurality of voice control means for giving at least one of the delay difference, the phase difference, and the gain difference to an input monaural voice signal in accordance with a sound image localization control transfer function based on the sound image localization control information generated by the sound image localization control information generating means; a plurality of audible sound output means for outputting audible sounds corresponding to the voice signals output from the plurality of voice signal control means; an audible sound input unit for inputting an audible sound; echo estimating means for estimating acoustic echoes input from the plurality of audible sound output means to the audible sound input unit, on the basis of estimated synthetic transfer functions between the audible sound input unit and the plurality of audible sound output means; subtracting means for subtracting the echoes estimated by the echo estimating means from the audible sound input from the audible sound input unit; first storage means for storing present and past sound image localization control transfer functions; second storage means for storing present and past estimated synthetic transfer functions; transfer function estimating means for estimating transfer functions between the plurality of audible sound output means and the audible sound input unit on the basis of the sound image localization control transfer functions stored in the first storage means and the estimated synthetic transfer functions stored in the second storage means; third storage means for estimating the transfer functions estimated by the transfer function estimating means; and synthetic transfer function generating means for, when the position of the image displayed on the screen changes, generating a new estimated synthetic transfer function on the basis of a new sound image localization control transfer function and the estimated transfer functions stored in the third storage means, all of which correspond to the change in position.

The transfer function estimating means is characterized by including means for estimating the respective acoustic transfer functions between the plurality of audible sound output means and the audible sound input unit by linear arithmetic processing between the present sound image localization control information, the past sound image localization control information, the present estimated synthetic echo path characteristic, and the past estimated synthetic echo path characteristic and further includes means for performing the linear arithmetic processing by performing multiplication between an inverse matrix of a matrix having the present sound image localization control information and the past sound image localization control information as elements and a matrix having the present estimated synthetic echo path characteristic and the past estimated synthetic echo path characteristic as elements.

Another echo canceler according to the present invention is characterized by comprising: estimating means for estimating a first pseudo echo path characteristic corresponding to at least one of a plurality of echo paths from echo path characteristics of the plurality of echo paths; generating means for generating a second pseudo echo path characteristic corresponding to at least one echo path except for the echo path corresponding to the first pseudo echo path characteristic estimated by the estimating means, using the first pseudo echo path characteristic estimate by the estimating means; and synthesizing means for synthesizing the first and second pseudo echo path characteristics corresponding to the plurality of echo paths.

The generating means is characterized by including means for generating a low-frequency component on the basis of the first pseudo echo path characteristic and generating a high-frequency component on the basis of a pseudo echo path characteristic of an echo path corresponding to the second pseudo echo characteristic.

According to the present invention, the respective acoustic transfer characteristics between a plurality of loudspeakers (audible sound output means) and microphones (audible sound input means) are estimated on the basis of present sound image localization information, past sound image localization information, a present estimated synthetic echo path characteristic, and a past estimated synthetic echo path characteristic. When the position of an image displayed on a screen changes, a new estimated synthetic echo path characteristic is generated on the basis of new sound image localization control information and a new acoustic transfer characteristic which correspond to this change in position.

Therefore, the cancel amount of the acoustic echoes will not decrease at low cost.

At least one of a plurality of pseudo echo path characteristics is generated using the pseudo echo path characteristics except for the echo path corresponding to this pseudo echo path characteristic. For this reason, acoustic echoes of a plurality of echo paths can be canceled at low cost.

According to the present invention, since the new estimated synthetic echo path characteristic is generated, the cancel amount of the acoustic echoes does not decrease, and the acoustic echoes of the plurality of echo paths can be canceled at low cost.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

Embodiments of the present invention will be described below with reference to the accompanying drawings.

Figure 3:
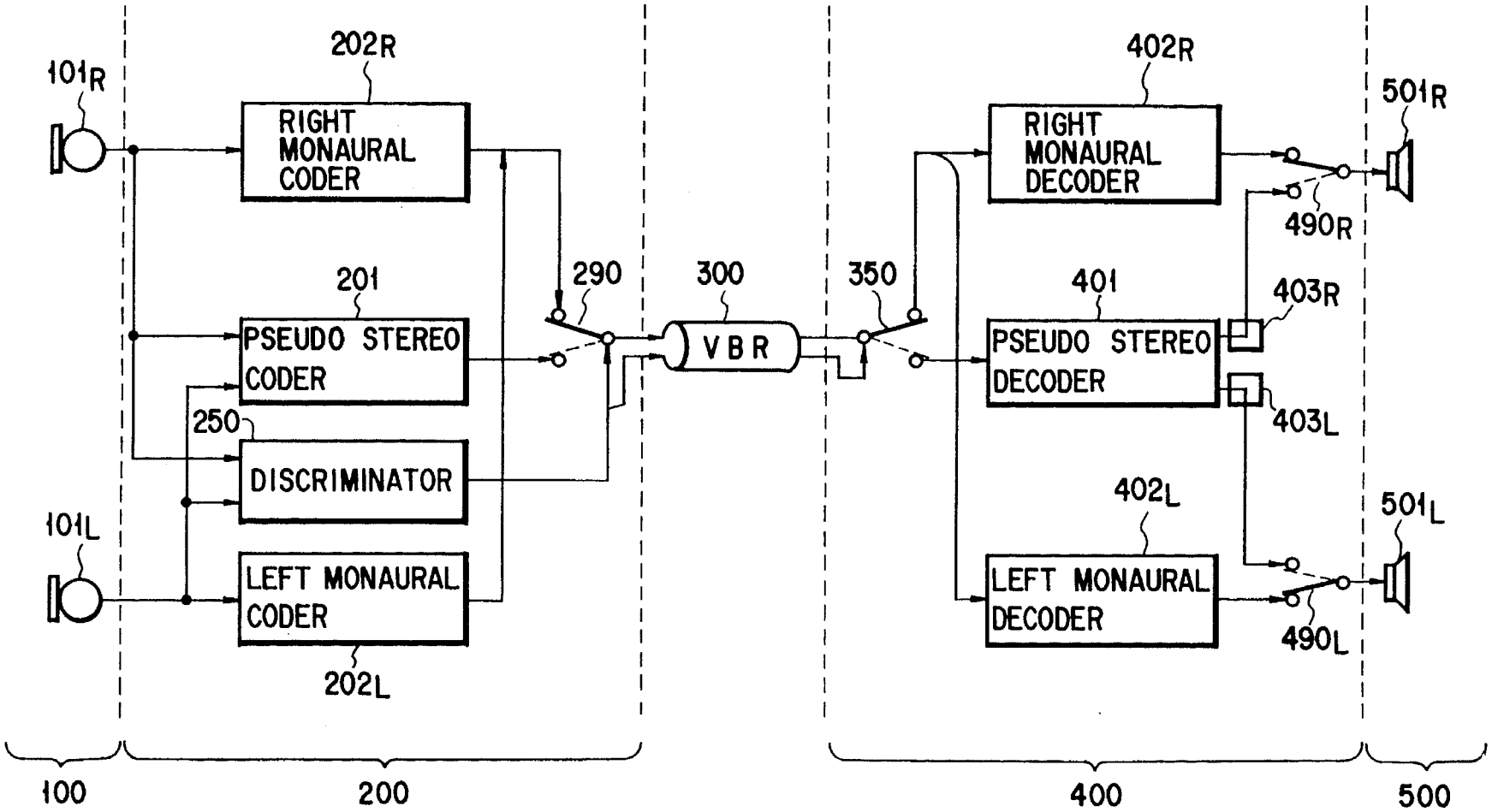
FIG. 3 is a schematic view showing the arrangement of a stereo voice transmission apparatus according to the first embodiment of the present invention.

FIG. 3 is a schematic view showing the arrangement of a stereo voice transmission apparatus according to the first embodiment of the present invention. Although a case using two left and right inputs and two left and right outputs will be described in this embodiment, the numbers of inputs and outputs are arbitrarily determined if the numbers are equal to each other.

The stereo voice transmission apparatus according to the present invention has a voice input unit 100, a coding unit 200, a transmitter 300, a decoding unit 400, and a voice output unit 500.

The voice input unit 100 has a right microphone $\mathbf{101}_R$ for inputting a voice on the right side and a left microphone $\mathbf{101}_L$ for inputting a voice on the left side.

The coding unit 200 has a pseudo stereo coder 201, a right monaural coder $\mathbf{202}_R$, a left monaural coder $\mathbf{202}_L$, a discriminator 250, and a first selector 290.

The pseudo stereo coder 201 compresses a sum of outputs from the left and right microphones, to, e.g., 56 kbps, and codes it in a single utterance mode.

The pseudo stereo coder 201 is a coder suitable for a single utterance of a pseudo stereo coding scheme or the like. The pseudo stereo coder 201 codes main information constituted by a voice of at least one channel of a plurality of channels and additional information serving as information for synthesizing a pseudo stereo voice on the basis of the main information. Each of the code output rates of the right monaural coder $\mathbf{202}_R$ and the left monaural coder $\mathbf{202}_L$ is equal to or higher than the code output rate of the pseudo stereo coder 201, and both the code output rates variably change.

The right monaural coder $\mathbf{202}_R$ and the left monaural coder $\mathbf{202}_L$ are monaural coders and code outputs from the right microphone $\mathbf{101}_R$ and the left microphone $\mathbf{101}_L$. These coders for a multiple utterance respectively code voice signals of a plurality of channels.

In a multiple simultaneous utterance mode, the right monaural coder $\mathbf{202}_R$ and the left monaural coder $\mathbf{202}_L$ respectively perform coding of output signals from the right and left microphones $\mathbf{101}_R$ and $\mathbf{101}_L$ in correspondence with a bit rate, e.g., 32 kbps, lower than that of the pseudo stereo coder 201.

The discriminator 250 discriminates a single speaker from a plurality of speakers on the basis of the outputs from the right and left microphones $\mathbf{101}_R$ and $\mathbf{101}_L$. More specifically, the discriminator 250 detects a level difference between the output signals from the left and right microphones, a delay difference therebetween, and the difference between the single utterance and the multiple simultaneous utterance so as to perform coding thereof in correspondence with a bit rate, e.g., 8 kbps.

The first selector 290 selects and outputs output signals from the right monaural coder $\mathbf{202}_R$ and the left monaural coder $202_L$ or an output signal from the pseudo stereo coder 201.

The transmitter 300 is a line capable of variably changing a transmission rate.

The decoding unit 400 has a second selector 350, a pseudo stereo decoder 401, a right pseudo stereo generator $403_R$, a left pseudo stereo generator $403_L$, a right monaural decoder $402_R$, a left monaural decoder $402_L$, a third selector $490_R$, and a fourth selector $490_L$.

The second selector 350 selects and outputs output signals from the right monaural decoder $402_R$ and the left monaural decoder $402_L$ or an output signal from the pseudo stereo decoder 401 on the basis of the discrimination result of the discriminator 250.

The pseudo stereo decoder 401 is a decoder suitable for a single utterance of a pseudo stereo scheme and decodes a code transmitted from the pseudo stereo coder 201 in the single utterance mode.

The right pseudo stereo generator $403_R$ and the left pseudo stereo generator $403_L$ give a delay difference and a gain difference to the decoded output to generate a pseudo stereo voice.

The right monaural decoder $402_R$ and the left monaural decoder $402_L$ are monaural decoders suitable for a multiple simultaneous utterance, and are for a stereo voice. The right monaural decoder $402_R$ and the left monaural decoder $402_L$ decode left and right codes transmitted from the right monaural coder $202_R$ and the left monaural coder $202_L$ in the multiple simultaneous utterance mode.

On the basis of a result obtained by discriminating the single utterance mode from the multiple simultaneous utterance mode, the third selector $490_R$ selects and outputs one of outputs from the right pseudo stereo generator $403_R$ and the left pseudo stereo generator $403_L$, and the fourth selector $490_L$ selects and outputs one of outputs from the right monaural decoder $402_R$ and the left monaural decoder $402_L$.

The voice output unit 500 has a right loudspeaker $501_R$ and a left loudspeaker $501_L$ and outputs a voice on the basis of outputs from the third and fourth selectors $490_R$ and $490_L$.

In the stereo voice transmission apparatus described above, when an utterance is made, the discriminator 250 discriminates it as a single utterance or a multiple utterance. If the utterance is a multiple utterance, the first selector 290, the second selector 350, the third selector $490_R$, and the fourth selector $490_L$ are set at positions indicated by solid lines, respectively. That is, a voice signal input from the microphone $101_R$ is coded in the right monaural coder $202_R$, and a voice signal input from the left microphone $101_L$ is coded in the left monaural coder $202_L$. These signals are respectively transmitted to the right monaural decoder $402_R$ and the left monaural decoder $402_L$ through the first selector 290, the transmitter 300, and the second selector 350 and decoded in the right monaural decoder $402_R$ and the left monaural decoder $402_L$. The decoded signals are output from the right loudspeaker $501_R$ and the left loudspeaker $501_L$ as voice signals, respectively, thereby realizing a stereo voice.

If the utterance is a single utterance, the discriminator 250 discriminates it as a single utterance, and the first selector 290, the second selector 350, the third selector $490_R$, and the fourth selector $490_L$ are set at positions indicated by dotted lines, respectively. That is, voice signals input from the right microphone $101_R$ and the left microphone $101_L$ are coded in the pseudo stereo coder 201, transmitted to the pseudo stereo decoder 401 through the first selector 290, the transmitter 300, and the second selector 350, and decoded in the pseudo stereo decoder 401. The decoded signals are output from the right loudspeaker $501_R$ and the left loudspeaker $501_L$ as voice signals, respectively, thereby reproducing a pseudo stereo voice.

With the above arrangement, in a single utterance mode which is large part of conversation, high-quality pseudo stereo voice transmission can be performed at a transmission rate of, e.g., 64 kbps by the pseudo stereo coder 201. In a multiple simultaneous utterance or other modes, perfect stereo voice transmission can be performed such that right coding and left coding are independently performed by the right monaural coder $202_R$ and the left monaural coder $202_L$. Therefore, in the multiple simultaneous utterance mode, coding transmission, although its quality is slightly lower than that in a single utterance mode, can be performed at a total of 64 kbps which is equal to that in the single utterance mode. For this reason, fluctuations of sound image localization in the multiple simultaneous utterance mode can be prevented while a coding rate is kept constant, and high-quality communication can be performed in the single utterance mode.

Each part will be described in detail below with reference to FIGS. 4 to 6. In the following description, a broad-band voice coding scheme having a bandwidth of 7 kHz is applied in a single utterance mode, and a telephone-band voice coding scheme is applied in a multiple simultaneous utterance mode or other modes.

Figure 4:
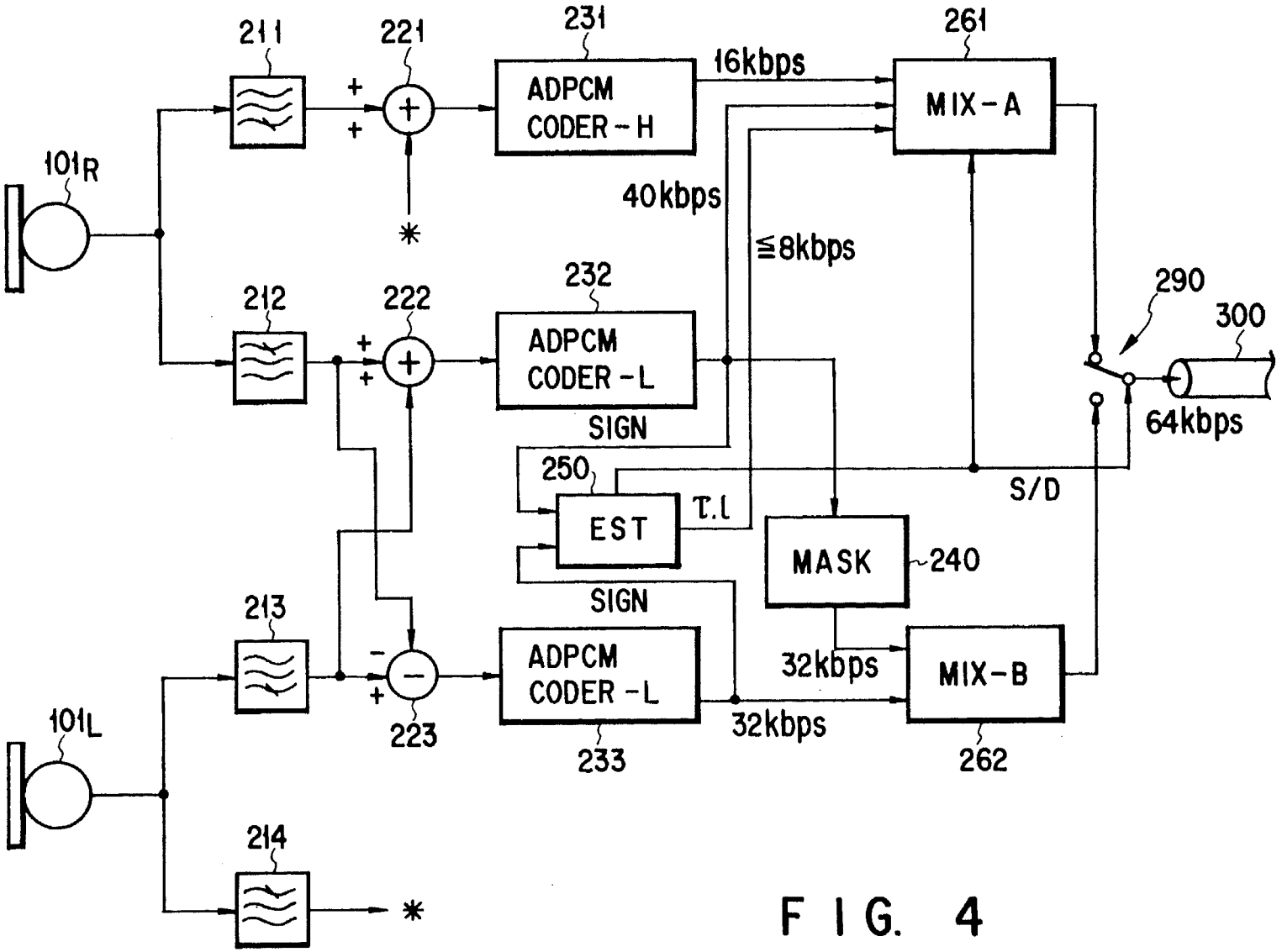
FIG. 4 is a view showing the arrangement of a coding unit of the stereo voice transmission apparatus according to the first embodiment of the present invention.

FIG. 4 is a view showing an arrangement of a coding unit of the stereo voice transmission apparatus according to the present invention.

An output voice from the right microphone $101_R$ is input to a high-pass filter 211 and a low-pass filter 212, and an output voice from the left microphone $101_L$ is input to a low-pass filter 213 and a high-pass filter 214. Each of the output voices is divided into a low-frequency component having a frequency range of 0 to 4 kHz (0 to 3.4 kHz in a multiple simultaneous utterance mode) and a high-frequency component having a frequency range of 4 to 7 kHz by the filters 211 to 214.

Output signals from the high-pass filter 211 and the high-pass filter 214 are added as left and right signals to each other by a first adder 221 and coded at 16 kbps by a first adaptive prediction (ADPCM) coder 231. The coded signal serves as part of transmission data in a single utterance mode.

Output signals from the low-pass filter 212 and the low-pass filter 213 are synthesized by a second adder 222 and a subtracter 223 as a sum component between the right and left signals and a difference component between the right and left signals.

An output signal from the second adder 222 and an output signal from the subtracter 223 are input to a second ADPCM coder 232 and a third ADPCM coder 233, respectively. The second ADPCM coder 232 codes the output from the second adder 222 at 40 kbps. The coded signal is used as part of transmission data in a single utterance mode and input to a mask unit 240 to remove an LSB every sampling operation. Each of data transmitted from the mask unit 240 and the third ADPCM coder 233 at 32 kbps serves as transmission data in a multiple simultaneous utterance mode.

Positive and negative sign components of output signals from the second ADPCM coder 232 and the third ADPCM coder 233 and input signals to the second ADPCM coder 232 and the third ADPCM coder 233 are input to the discriminator 250. In the discriminator 250, level and delay differences between the right and left signals are detected, and at the same time, discrimination between a single utterance and a multiple simultaneous utterance is performed.

A single utterance data synthesizer 261 synthesizes a 16-kbps ADPCM high-frequency code, a 40-kbps ADPCM code of a low-frequency sum component, and an 8-kbps output code output from the discriminator 250 to generate transmission data.

A multiple simultaneous utterance synthesizer 262 synthesizes a 32-kbps output code from the second ADPCM coder 232 (mask unit 240) and a 32-kbps output code from the third ADPCM coder 233 to generate 64-kbps transmission data.

As transmission data, any one of the above transmission data is selected by the first selector 290 in accordance with a discrimination signal which is an output from the discriminator 250. The selected transmission data is transmitted to a 64-kbps line.

Figure 5:
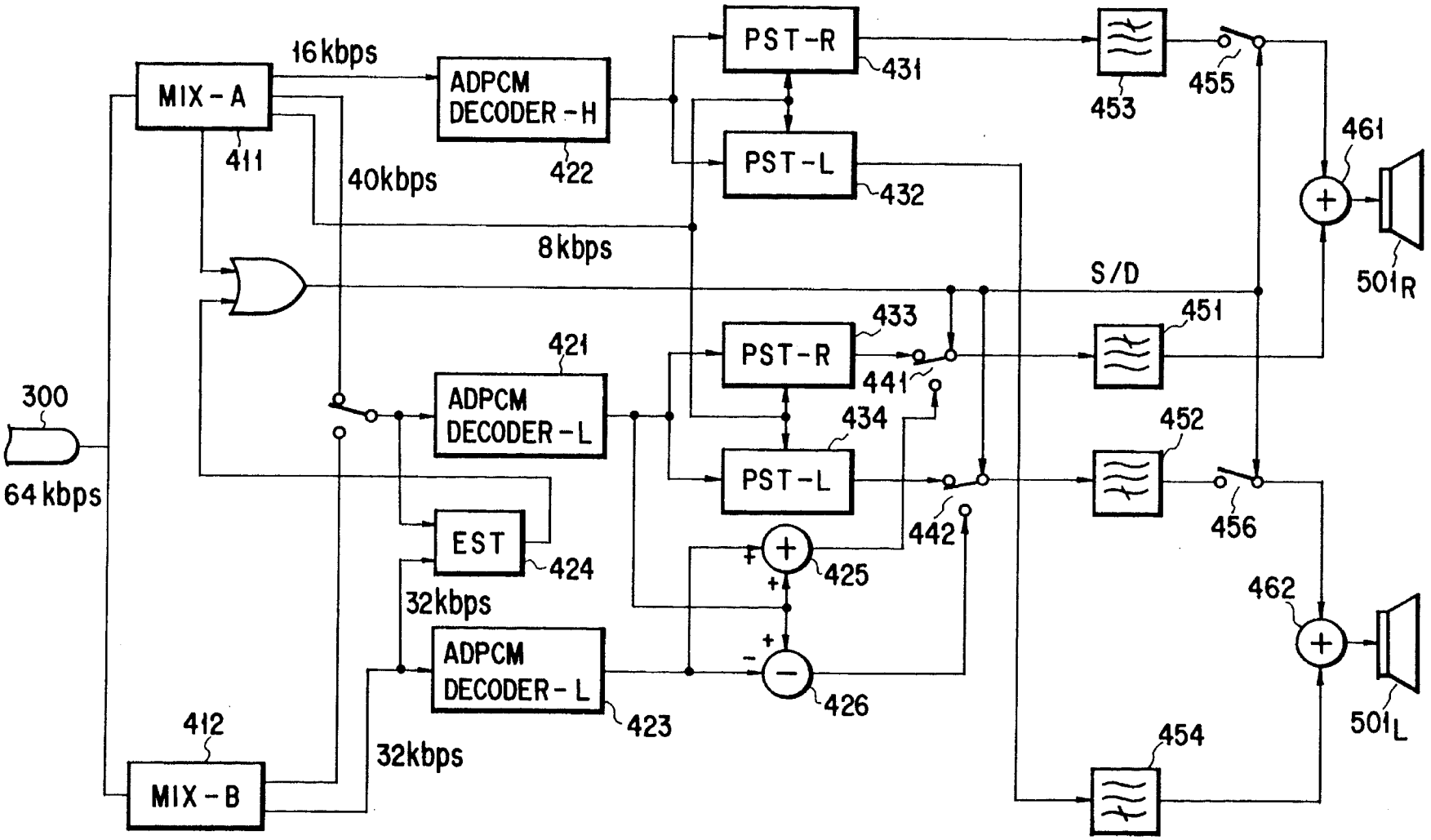
FIG. 5 is a view showing the arrangement of a decoding unit of the stereo voice transmission apparatus according to the first embodiment of the present invention.

FIG. 5 is a view showing the arrangement of the decoding unit 400 of the stereo voice transmission apparatus.

The 64-kbps data coded in the coding unit 200 is input to a first distributor 411 for a single utterance and a second distributor 412 for a multiple simultaneous utterance.

A 40-kbps ADPCM code of an output from the first distributor 411 for a single utterance is input to a low-frequency first ADPCM decoder 421, and a 16-kbps ADPCM code is input to a high-frequency second ADPCM decoder 422. Outputs from the first and second ADPCM decoders 421 and 422 are output to a first pseudo stereo synthesizer 431, a second pseudo stereo synthesizer 432, a third pseudo stereo synthesizer 433, and a fourth pseudo stereo synthesizer 434 to generate left and right pseudo stereo voices on the basis of an 8-kbps output from the first distributor 411 and serving as the delay and gain differences detected by the coding unit 200. Thereafter, the pseudo stereo voices are input to low-pass filters 451 and 452 each having a bandwidth of 0.2 to 4 kHz (3.4 kHz in the multiple simultaneous utterance mode) for bandwidth synthesis and high-pass filters 453 and 454 each having a bandwidth of 4 to 7 kHz. Outputs from the filters 451 to 454 are bandwidth-synthesized by an adder 461 and an adder 462 and used as decoded signals in a single utterance mode.

Two 32-kbps data which are outputs from the second distributor 412 for a multiple simultaneous utterance are decoded by the low-frequency first ADPCM decoder 421 and a low-frequency third ADPCM decoder 423 and input to an adder 425 and a subtracter 426 which restore left and right signals from a sum component and a difference component. These outputs are input to the low-pass filter 451 and the low-pass filter 452 for bandwidth synthesis by switches 441 and 442 only when a multiple simultaneous utterance mode is set.

The positive and negative sign components of input codes to the low-frequency first and third ADPCM decoders 421 and 423 are input to an discriminator 424 and used as switching signals for switching a multiple simultaneous utterance state to a single utterance state.

Switches 455 and 456 are used to suppress a high-frequency component which cannot be decoded in the multiple simultaneous utterance mode.

Figure 6:
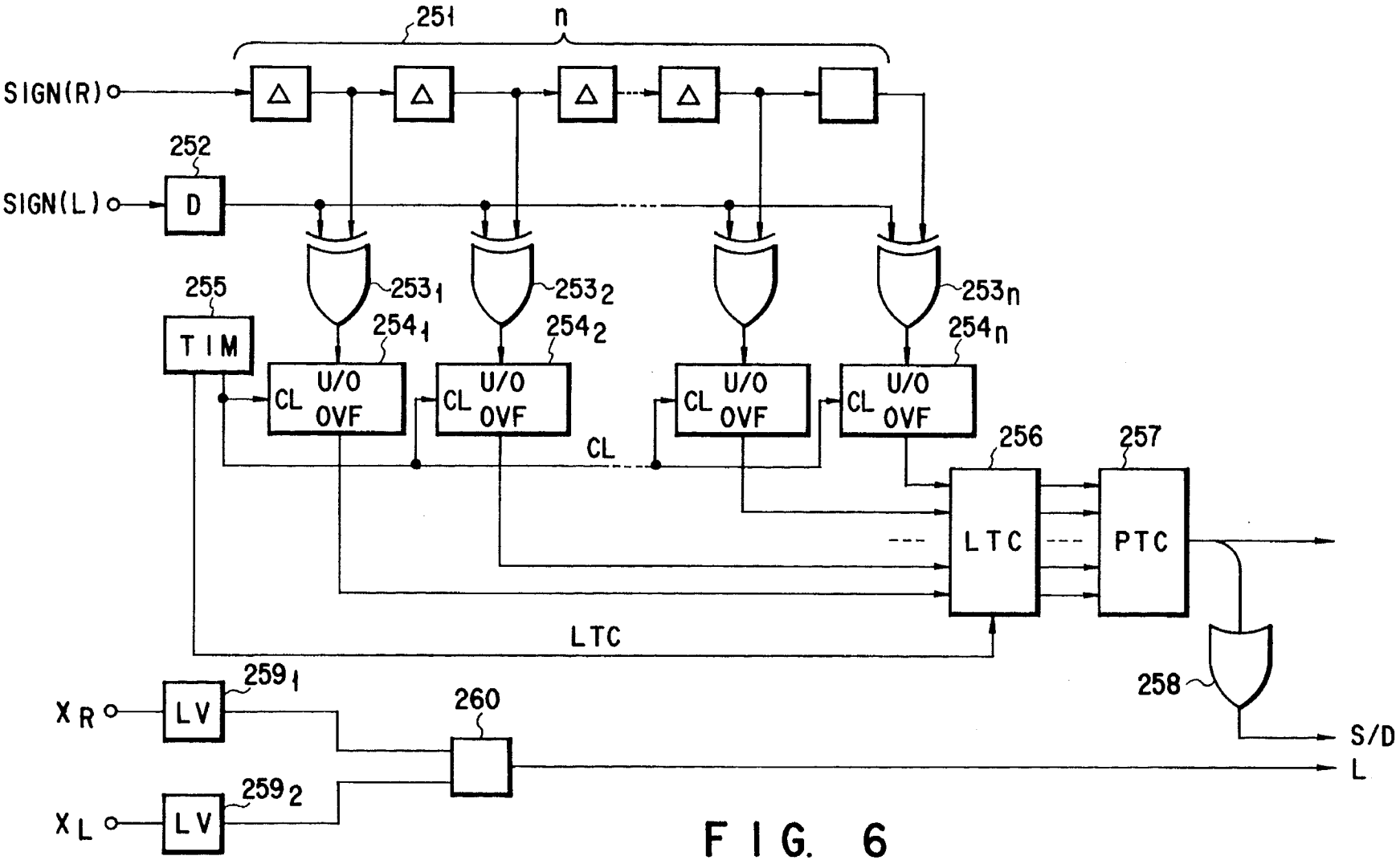
FIG. 6 is a view showing the arrangement of a discriminator used in the coding unit according to the first embodiment.

FIG. 6 is a view showing the arrangement of the discriminator 250 used in the coding unit 200. Since the discriminator 424 used in the decoding unit 400 has the same arrangement as that of the discriminator 250, an operation of only the discriminator 250 used in the coding unit 200 will be described below.

The discriminator 250 has tapped delay lines $\mathbf{251}_1, \ldots, \mathbf{251}_n$ for n samples, a delay line 252 for n/2 samples, exclusive OR circuits $\mathbf{253}_1, \ldots, \mathbf{253}_n$, up/down counters $\mathbf{254}_1, \ldots, \mathbf{254}_n$, a timer 255, a latch 256, a decoder circuit 257, and an OR circuit 258.

The tapped delay lines $\mathbf{251}_1, \ldots, \mathbf{251}_n$ receive one signal SIGN(R) (right component) of the positive/negative sign components of left and right microphone outputs. The delay line 252 receives the other positive/negative component (left component) to establish the law of causation of the left and right components.

The exclusive OR circuits $\mathbf{253}_1, \ldots, \mathbf{253}_n$ determine coincidences between the delay line 252 and the tapped delay lines $\mathbf{251}_1, \ldots, \mathbf{251}_n$.

As shown in FIG. 6, the signal SIGN(R) (the right component in this embodiment) of the positive/negative sign components of the low-frequency second ADPCM coder 232 for the right channel and the low-frequency third ADPCM coder 233 for the left channel is input to the tapped delay lines 251 for n samples. On the other hand, the other positive/negative sign component (the left component in this embodiment) is input to the delay line 252 for n/2 samples to establish the law of causation of the left and right components. Output signals from these delay lines are input to the exclusive OR circuits $\mathbf{253}_1, \ldots, \mathbf{253}_n$ respectively corresponding to the taps of the delay lines 251, and input to the up/down counters $\mathbf{254}_1, \ldots, \mathbf{254}_n$.

The up/down counters $\mathbf{254}_1, \ldots, \mathbf{254}_n$ are cleared every T samples, and average processing of the input signals is performed, thereby obtaining code correlations between the T samples.

The timer 255 generates a clear signal CL and a latch signal LTC every T samples. In general, T is set to be, e.g., about 100 msec.

The latch 256 latches output signals from the up/down counters $\mathbf{254}_1, \ldots, \mathbf{254}_n$ immediately before the up/down counters $\mathbf{254}_1, \ldots, \mathbf{254}_n$ are cleared.

The decoder circuit 257 codes an output signal from the latch 256 to generate left and right delay difference information g which is updated every T samples.

A code corresponding to the state in which all outputs, from the latch 256, of outputs from the decoder circuit 257 are "0"s is detected by the OR circuit 258. when "0" is obtained, i.e., when no correlation output between the T samples is obtained, a multiple simultaneous utterance state is discriminated.

The OR circuit 258 detects a code corresponding to 10 the state in which all the outputs, from the latch 256, of the output signals from the decoder circuit 257 are "0"s. when "0" is obtained, i.e., when no correlation output between the T samples is obtained, a multiple simultaneous utterance state is discriminated.

A signal output from the above circuit is also used in the discriminator 424 of the decoding unit 400 and serves as a switching signal for switching a multiple simultaneous utterance to a single utterance in the decoding unit 400.

In the coding unit 200, the discriminator 250 further includes a first level detector $\mathbf{259}_1$, a second level detector $\mathbf{259}_2$, and a comparator 260, and a ratio L of a left level to a right level is detected. This information constitutes additional information together with a delay difference.

According to the first embodiment, relatively simple processing is performed for a broad-band monaural ADPCM coder or decoder which is popularly used, and a stereo voice coding scheme in which sound image localization does not fluctuate even in a multiple simultaneous utterance mode can be realized.

In the first embodiment, a case wherein a transmission rate in a single utterance mode is equal to that in a multiple simultaneous utterance mode has been described. However, in the second embodiment, a case wherein a transmission rate in a single utterance mode is different from that in a multiple simultaneous utterance mode will be described.

Since the overall arrangement of the second embodiment is the same as that of the first embodiment, an illustration and description thereof will be omitted.

Figure 7:
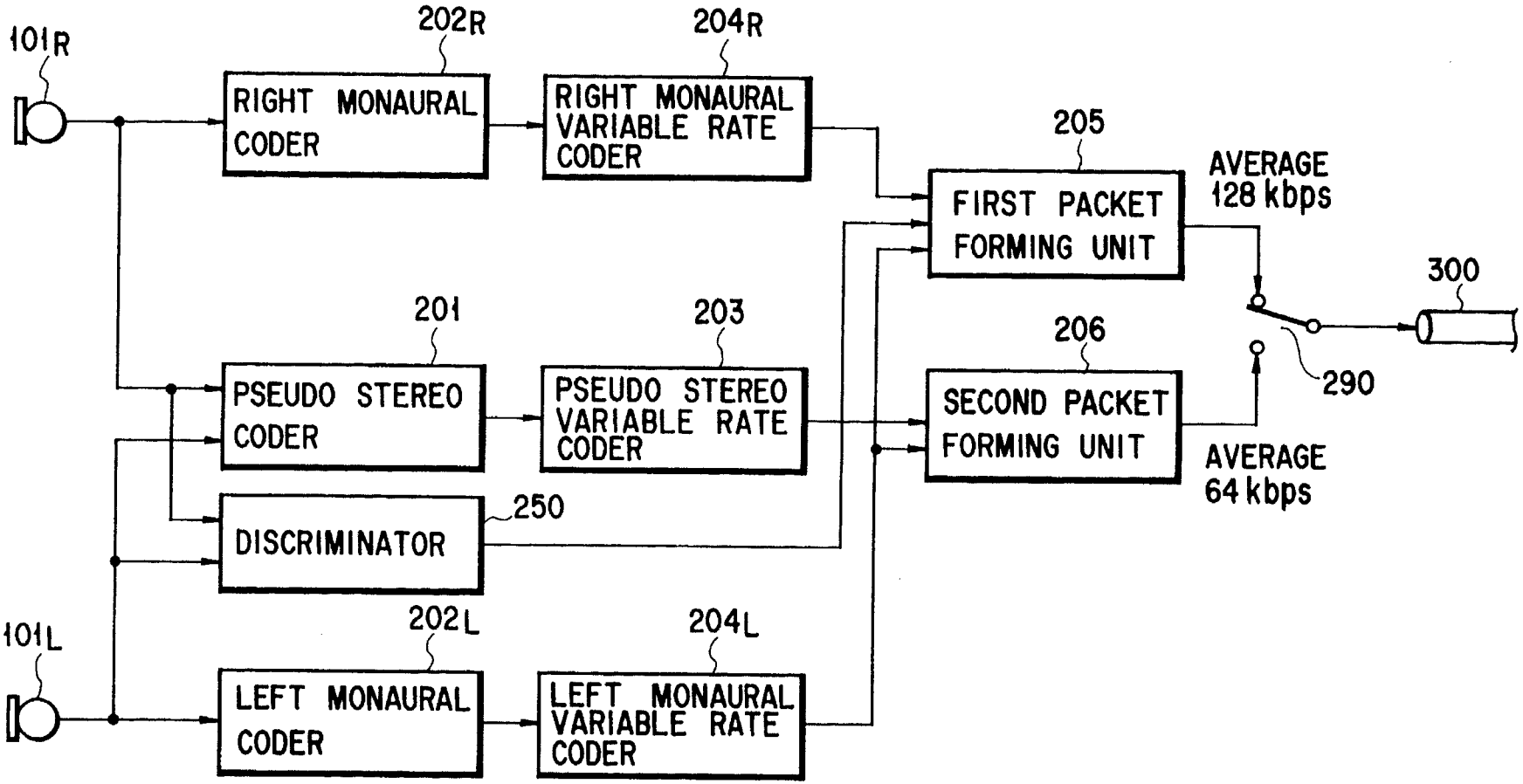
FIG. 7 is a view showing the arrangement of a coding unit of a stereo voice transmission apparatus according to the second embodiment of the present invention.

FIG. 7 is a view showing an arrangement of the coding unit of a stereo voice transmission apparatus according to the second embodiment of the present invention. The same reference numerals as in the first embodiment denote the same parts in FIG. 7, and a description thereof will be omitted.

A coding unit 200 has a pseudo stereo coder 201, a right monaural coder $\mathbf{202}_R$, a left monaural coder $\mathbf{202}_L$, a pseudo stereo variable rate coder 203, a right monaural variable rate coder $\mathbf{204}_R$, a left monaural variable rate coder $\mathbf{204}_L$, a first packet forming unit 205, a second packet forming unit 206, a discriminator 250, and a first selector 290.

The right monaural coder $\mathbf{202}_R$ and the left monaural coder $\mathbf{202}_L$ are coders for a multiple simultaneous utterance. For example, the right and left monaural coders $\mathbf{202}_R$ and $\mathbf{202}_L$ are realized such that a broad-band voice coding scheme such as CCITT recommendations G.722 is independently applied to the left and right channels. The right monaural variable rate coder $\mathbf{204}_R$ and the left monaural variable rate coder $\mathbf{204}_L$ are obtained such that a run length coding scheme or a Huffman coding scheme is applied to output signals from the right monaural coder $\mathbf{202}_R$ and the left monaural coder $\mathbf{202}_L$.

The pseudo stereo coder 201, as described above, is disclosed in Jpn. Pat. Appln. KOKAI Application No. 62-51844. The pseudo stereo variable rate coder 203 codes an output signal from the pseudo stereo coder 201.

Figure 1:
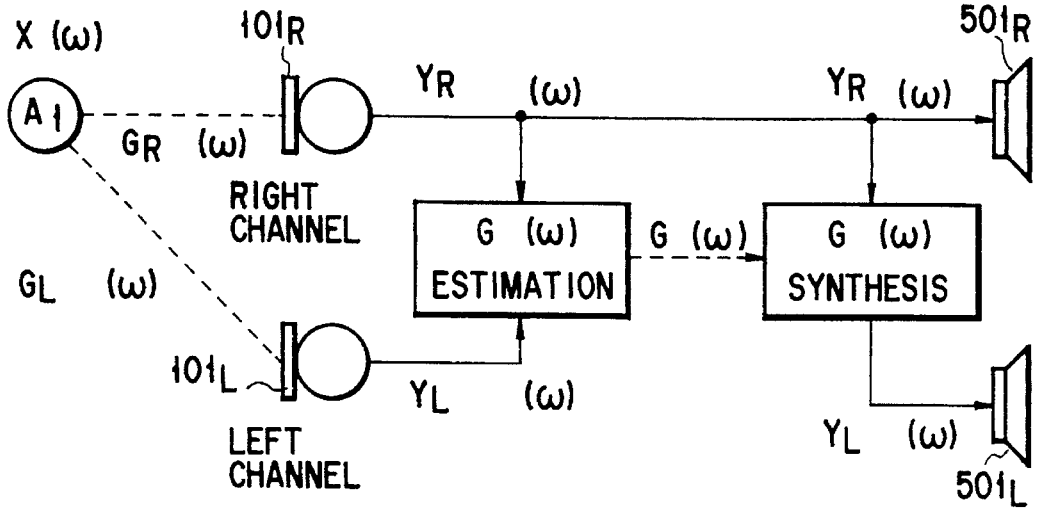
FIG. 1 (PRIOR ART)
FIG. 1 is a view for explaining a conventional stereo voice transmission scheme.
Figure 2:
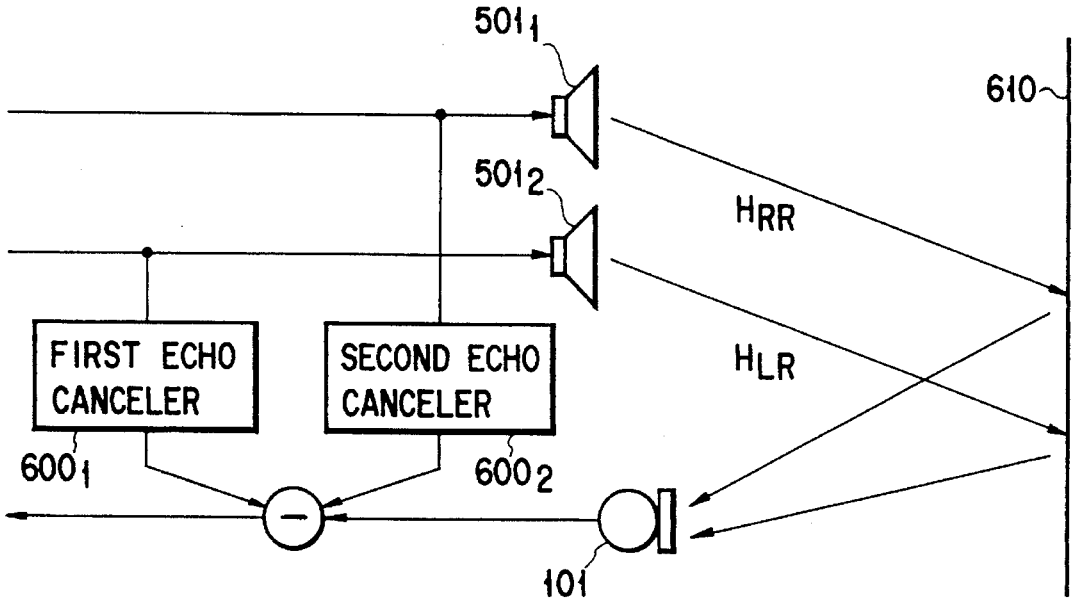
FIG. 2 (PRIOR ART)
FIG. 2 is a view showing the arrangement of conventional stereo voice echo canceler.

As shown in FIG. 1, a voice $X(\omega)$ of a speaker $A_1$ is transmitted to a right microphone $\mathbf{101}_R$ of a right channel as a voice signal $Y_R(\omega)$ and to a left microphone $\mathbf{101}_L$ of a left channel as a voice signal $Y_L(\omega)$. On the transmission side, a sum signal between the right-channel voice signal $Y_R(\omega)$ and the left-channel voice signal $Y_L(\omega)$ is directly transmitted. A transfer function is estimated by the left channel voice signal $Y_L(\omega)$ and the right-channel voice signal $Y_R(\omega)$ in accordance with the following equation:

$$G(\omega)=(Y_L(\omega)/Y_R(\omega)]$$

Thereafter, a delay g and a gain $\omega$ are extracted from the transfer function $G(\omega)$ and transmitted as additional information.

In the decoding unit, estimated transfer functions $G_R(\omega)$ and $G_L(\omega)$ synthesized by the additional information and a left- and right-channel sum voice signal $Y_R(\omega)+Y_L(\omega)$ are synthesized and reproduced by the left- and right-channel voice signal $Y_R(\omega)+Y_L(\omega)$ in accordance with the following equations:

$$Y_L'(\omega)=G_L'(\omega)\ .\ (Y_R(\omega)+Y_L(\omega))$$

$$Y_R'(\omega)=G_R'(\omega)\ .\ (Y_R(\omega)+Y_L(\omega))$$

In this case, when the coding rate of the pseudo stereo coder 201 is set to be equal to or higher than that of the right monaural coder $\mathbf{202}_R$ or the left monaural coder $\mathbf{202}_L$, excellent matching of coding rates can be obtained.

Referring to FIG. 7, coded outputs suitable for a single utterance and a multiple simultaneous utterance are as follows. That is, single utterance discrimination information and multiple utterance discrimination information are transmitted to the first packet forming unit 205 and the second packet forming unit 206, respectively, to form packets. By the operation of the first selector 290, an output from the second packet forming unit 206 is transmitted to the reception side through a transmitter 300 in a single utterance mode, and an output from the first packet forming unit 205 is transmitted to the reception side through the transmitter 300 in a multiple simultaneous utterance mode.

Figure 8:
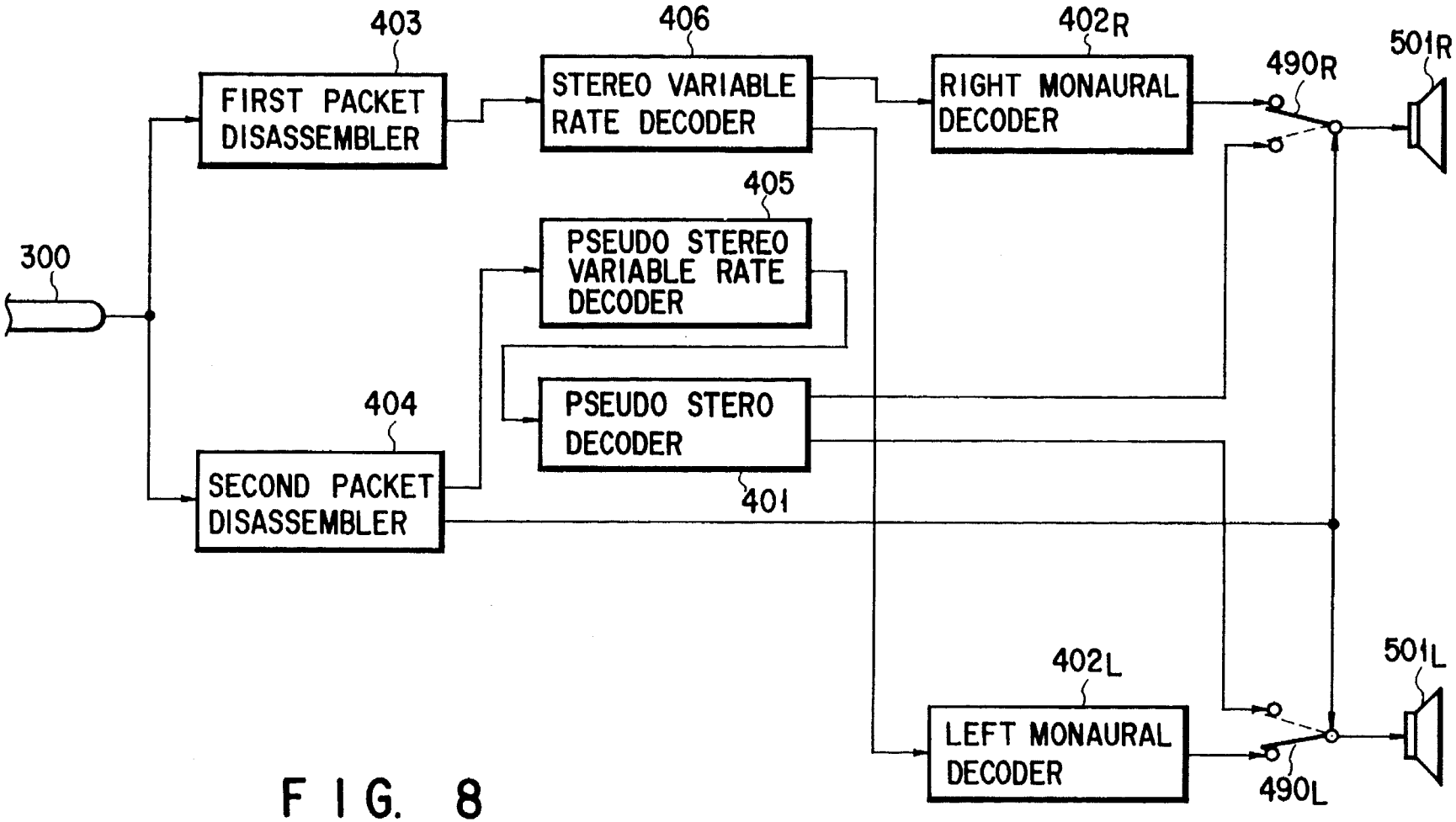
FIG. 8 is a view showing the arrangement of a decoding unit of the stereo voice transmission apparatus according to the second embodiment of the present invention.

FIG. 8 is a view showing the arrangement of a decoding unit of the stereo voice transmission apparatus according to the second embodiment of the present invention.

A decoding unit 400 has a pseudo stereo decoder 401, a right monaural decoder $\mathbf{402}_R$, a left monaural decoder $\mathbf{402}_L$, a first packet disassembler 403, a second packet disassembler 404, a pseudo stereo variable rate decoder 405, a stereo variable rate decoder 406, a third selector $\mathbf{490}_R$, and a fourth selector $\mathbf{490}_L$.

The first packet disassembler 403 and the second packet disassembler 404 disassemble the transmitted packets to extract required information.

The first packet disassembler 403 extracts a multiple simultaneous utterance signal to transmit it to the stereo variable rate decoder 406.

The second packet disassembler 404 extracts a single utterance signal to transmit it to the pseudo stereo variable rate decoder 405 and controls the third selector $\mathbf{490}_R$ and the fourth selector $\mathbf{490}_L$ on the basis of a discrimination signal from the discriminator 250. In the multiple simultaneous utterance mode, the third selector $\mathbf{490}_R$ and the fourth selector $\mathbf{490}_L$ are set at positions indicated by solid lines in FIG. 8. In a single utterance mode, the third selector $\mathbf{490}_R$ and the fourth selector $\mathbf{490}_L$ are set at positions indicated by dotted lines in FIG. 8.

The stereo variable rate decoder 406 decodes an output signal from the first packet disassembler 403 to transmit it to the right and left monaural decoder $\mathbf{402}_R$ and $\mathbf{402}_L$ which are used for a multiple simultaneous utterance.

The right and left monaural decoders $\mathbf{402}_R$ and $\mathbf{402}_L$ decode an output signal from the stereo variable rate decoder 406.

The pseudo stereo variable rate decoder 405 decodes a single utterance signal output from the second packet disassembler 404.

The pseudo stereo decoder 401 decodes an output signal from the pseudo stereo variable rate decoder 405.

In a multiple simultaneous utterance mode, the third selector $\mathbf{490}_R$ and the fourth selector $\mathbf{490}_L$ are set at the positions indicated by the solid lines, and output signals from the right monaural decoder $\mathbf{402}_R$ and the left monaural decoder $\mathbf{402}_L$ are transmitted to right and left loudspeakers $\mathbf{501}_R$ and $\mathbf{501}_L$ to obtain voice signals.

In a single utterance mode, the third selector $\mathbf{490}_R$ and the fourth selector $\mathbf{490}_L$ are set at the positions indicated by the dotted lines, and an output signal from the pseudo stereo decoder 401 is transmitted to the right and left loudspeakers $\mathbf{501}_R$ and $\mathbf{501}_L$ to obtain voice signals.

According to the second embodiment, as in the first embodiment, a pseudo stereo broad-band voice coding scheme is used in the single utterance mode, and a perfect stereo broad-band voice coding scheme is used in the multiple simultaneous utterance mode or other modes so as to perform stereo voice transmission/accumulation. For this reason, efficient stereo voice transmission/accumulation having the enhanced effect of presence can be performed.

In the first and second embodiments, stereo voice transmission has been described. The following embodiment will describe an echo canceler for canceling an echo caused by a plurality of loudspeakers.

Figure 9:
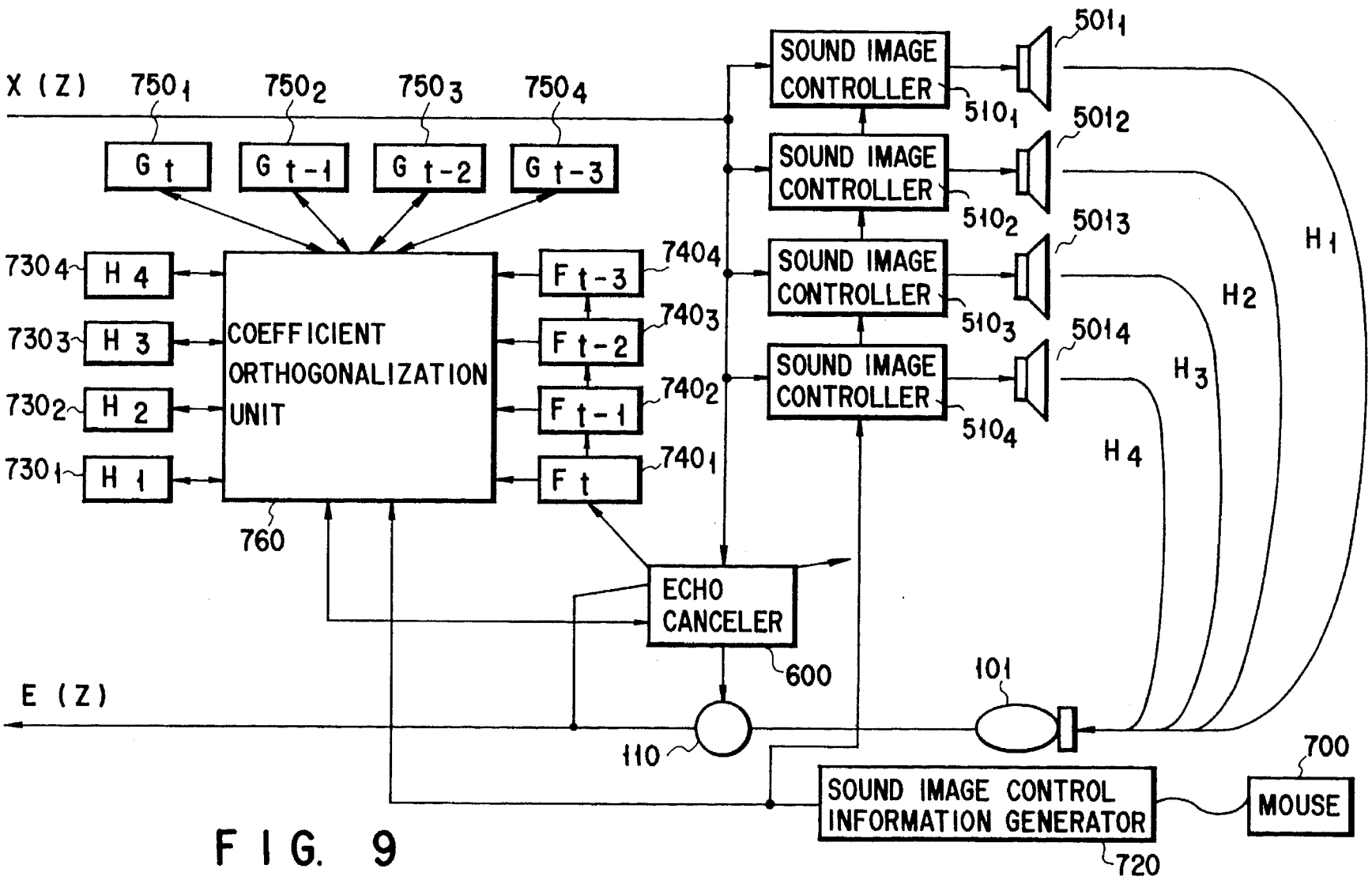
FIG. 9 is a view showing the arrangement of an voice input unit in a multimedia terminal according to the third embodiment of the present invention.
Figure 10:
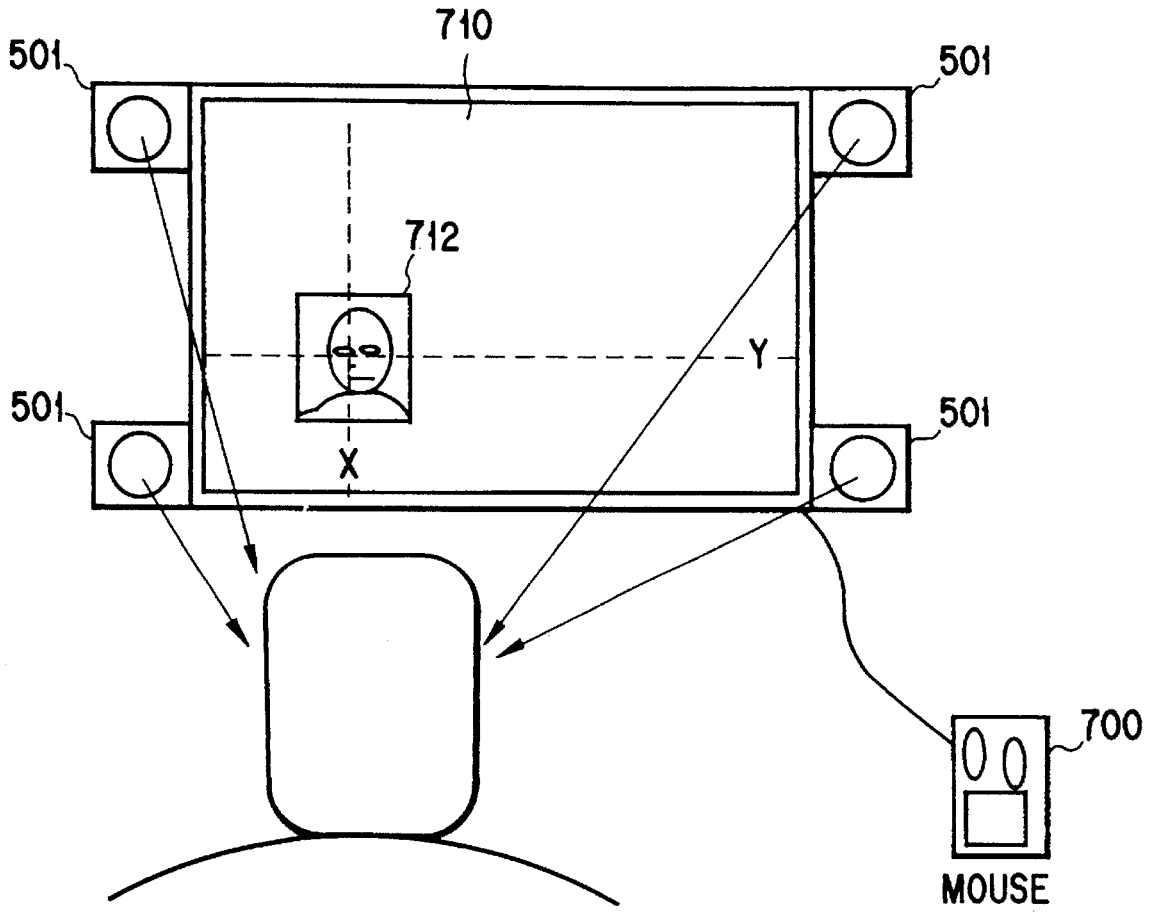
FIG. 10 is a view showing an image display in the multimedia terminal according to the third embodiment of the present invention.

FIG. 9 is a view showing the arrangement of a voice input/output unit of a multimedia terminal according to the third embodiment of the present invention, and FIG. 10 is a view showing an image display.

Referring to FIG. 9, a mouse 700 designates the position of an image displayed on a screen. For example, as shown in FIG. 10, when X- and Y-coordinates are input with the mouse 700, an image processor (not shown) displays an image 712 of a speaker having a predetermined size on a screen 710 around an X-Y cross point.

Figure 11:
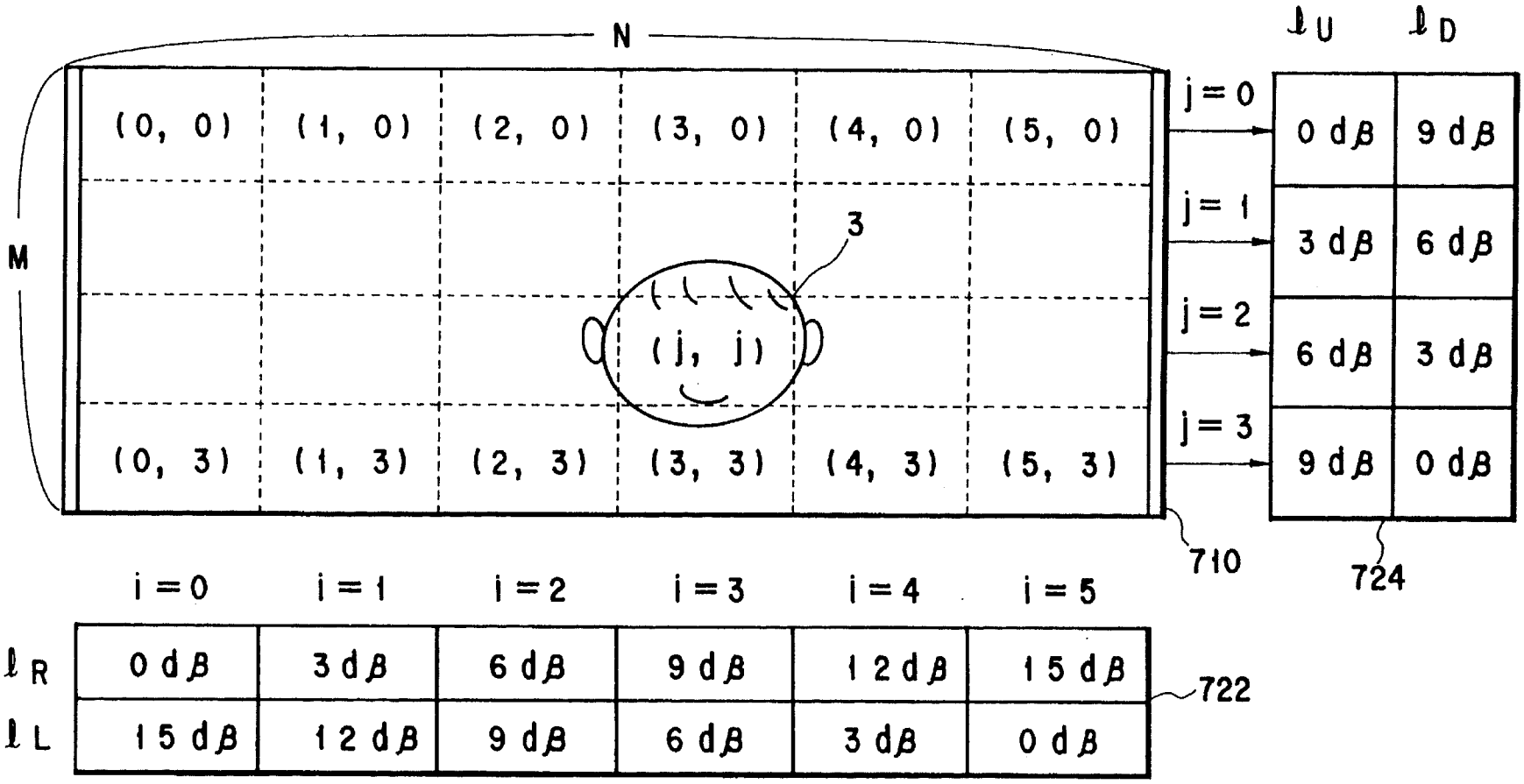
FIG. 11 is a view for explaining a sound image localization control information generator in FIG. 9.

A sound image localization control information generator 720 generates a plurality of pieces of sound image localization control information $L_k$ including, as information, at least one of delay, phase, and gain differences determined in correspondence with the position of the image displayed on the screen. When the plurality of pieces of sound image localization control information $L_k$ are used, for example, as shown in FIG. 11, sound image localization control is performed as if a voice is produced from the position of speaker's mouth of the image 712 on the screen 710. More specifically, the screen 710 is divided into N×M blocks, and sound image localization is controlled in units of blocks. Even when any one of the delay, phase, and gain differences is used, or a combination of the differences is used, the above sound image localization control can be performed. However, in this case, an example using the gain difference will be described below.

In the sound image localization control information generator 720, as shown in FIG. 11, a gain table 722 corresponding to divided positions in the X direction (horizontal direction) and a gain table 724 corresponding to divided positions in the Y direction (vertical direction) are arranged. A gain $l_{Ri}$ (where i is the coordinate position in the X direction) for a right loudspeaker and a gain $l_{Li}$ for a left loudspeaker are written in the gain table 722. A gain $l_{Uj}$ (where j is the coordinate position in the Y direction) for an upper loudspeaker and a gain $l_{Dj}$ for a lower loudspeaker are written in the gain table 724. When the position of an image, i.e., a coordinate (i,j), is input by the mouse 700, the gains $l_{Ri}$, $l_{Li}$, $l_{Uj}$, and $l_{Dj}$ corresponding to the coordinate (i,j) are read out from the gain tables 722 and 724. In this case, assume that: the gain of an upper right loudspeaker is set to be $L_{RU}(i,j)$; the gain of a lower right loudspeaker is set to be $L_{RD}(i,j)$; the gain of an upper left loudspeaker is set to be $L_{LU}(i,j)$; and the gain of a lower left loudspeaker is set to be $L_{LD}(i,j)$. In this case, the gains of the loudspeakers are obtained by the calculation constituted by the following equations:

$$L_{RU}(i,J)=l_{Ri} \cdot l_{Uj}$$

$$L_{RD}(i,J)=l_{Ri} \cdot l_{Dj}$$

$$L_{LU}(i,J)=l_{Li} \cdot l_{Uj}$$

$$L_{LD}(i,J)=l_{Li} \cdot l_{Dj} \quad (5)$$

Sound image localization controllers $\mathbf{510}_k$ (k=1to 4) give at least one of the delay, phase, and gain differences to an input monaural voice signal X(z) on the basis of the sound image localization control information $L_k$ generated by the sound image localization control information generator 720. In this case, assuming that the sound image localization control transfer function of each of the sound image localization controllers $\mathbf{510}_k$ is represented by $G_k(z)$, the following calculation is performed in each of the sound image localization controllers $\mathbf{510}_k$.

$$G_k(z)=L_k \cdot Z^{\tau k} \quad (6)$$

A gain difference or the like is given to the input monaural voice signal X(z).

Loudspeakers $\mathbf{501}_k$ output the outputs from the sound image controllers $\mathbf{510}_k$ as audible sounds. For example, as shown in FIG. 10, the loudspeaker $\mathbf{501}_1$ is an upper right loudspeaker, the loudspeaker $\mathbf{501}_2$ is a lower right loudspeaker, the loudspeaker $\mathbf{501}_3$ is an upper left loudspeaker, and the loudspeaker $\mathbf{501}_4$ is a lower left loudspeaker when a gain difference and the like are output from the loudspeakers $\mathbf{501}_k$ as different audible sounds, a listener in front of the terminal feels as if a voice is produced from the position of speaker's mouth of the image 712 on the screen 710.

A microphone 101 receives an audible sound produced from the listener in front of the terminal.

An echo canceler 600 estimates an acoustic echo signal input from the loudspeakers $\mathbf{501}_k$ to the microphone 101 again on the basis of estimated synthetic transfer functions F'(z) between the microphone 101 and the loudspeakers $\mathbf{501}_k$.

A subtracter 110 subtracts the acoustic echo signal estimated by the echo canceler 600 from the voice signal output from the microphone 101.

Estimated transfer function memories $\mathbf{730}_k$ store estimated transfer functions $H'_k(z)$ between the microphone 101 and the loudspeakers $\mathbf{501}_k$.

Estimated synthetic transfer function memories $\mathbf{740}_n$ store estimated synthetic transmission functions $F'_t(z)$ to $F'_{t-N+1}(z)$ (emphasized letters represent vectors hereinafter) at present moment (t) and a plurality of past moments (t–N+1).

Sound image localization control information memories $\mathbf{750}_n$ store estimated synthetic transmission functions $G_{k,t}(z)$ to $G_{k,t-N+1}(z)$ at the present moment (t) and the plurality of past moments (t–N+1).

A coefficient orthogonalization unit 760 estimates the estimated synthetic transfer function F'(z). The operation of the coefficient orthogonalization unit 760 will be described below with reference to FIG. 12.

Figure 12:
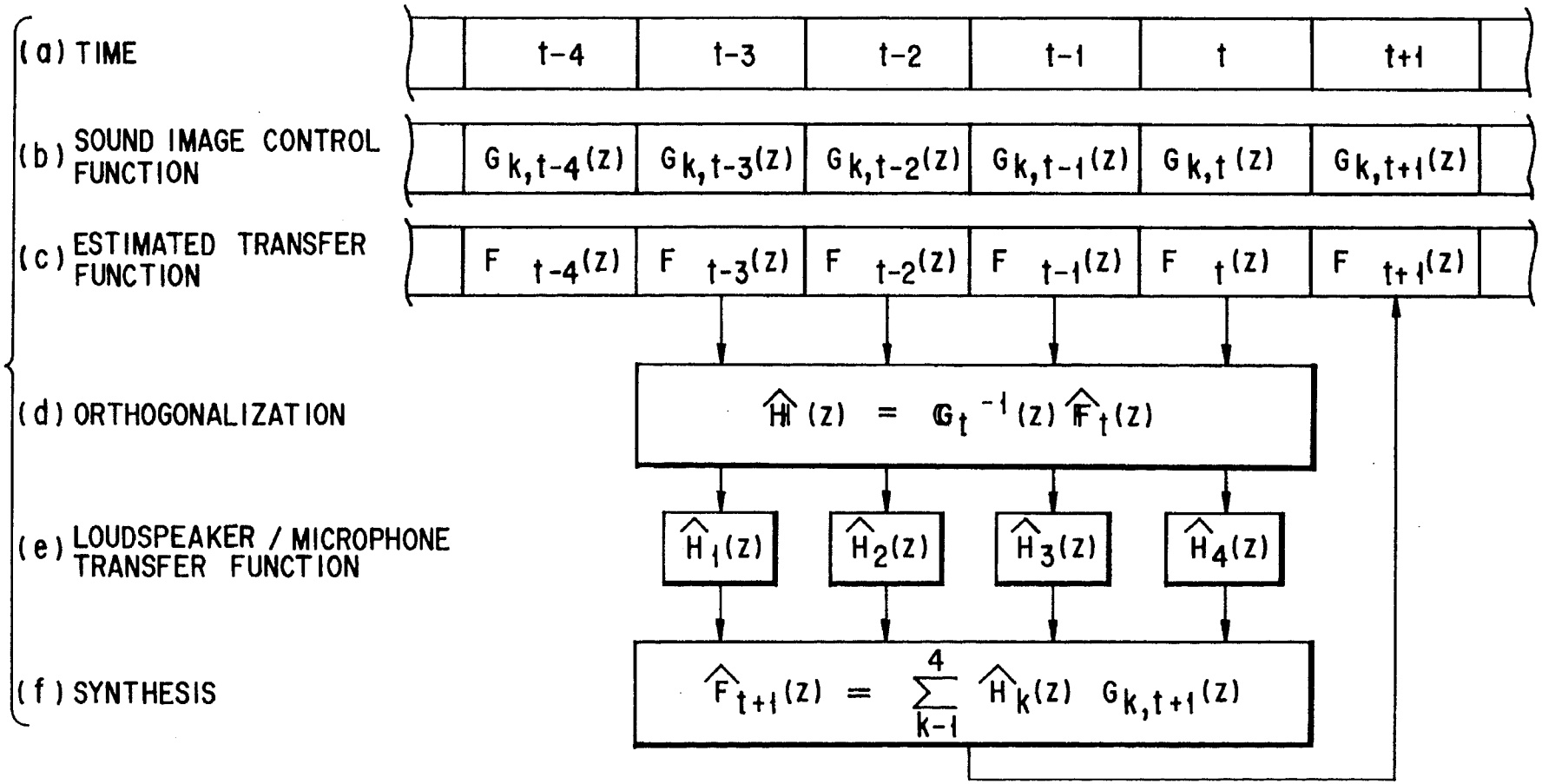
FIG. 12 is a view for explaining the operation of the coefficient orthogonalization unit in FIG. 9.

Assume that a period of time in which the position of speaker's mouth of the image 712 on the screen 710 is located at the same block (i,j) is one unit time (FIG. 12(*a*)). In this case, when the equation (6) is used, the sound image localization control transfer functions $G_{k,t}(z)$ of the sound image localization controllers $\mathbf{510}_k$ in the t-th unit time can be expressed as follows (FIG. 12(*b*)):

$$G_{k,t}(z)=L_{kt} \cdot Z^{-\tau kt} \quad (7)$$

Transfer functions $H_{kt}(z)$ between the microphone 101 and the loudspeakers $\mathbf{501}_k$ at time t when viewed from the echo canceler 600 are as follows:

$$H_{kt}(z)=G_{k,t}(z) \cdot H_k(z) \quad (8)$$

where $H_k(z)$ is each of the transfer functions between the microphone 101 and the loudspeakers $\mathbf{501}_k$.

In this manner, echo path characteristics $F_t(z)$ between the microphone 101 and the loudspeakers $\mathbf{501}_k$ at time t when viewed from the echo canceler 600 are as follows:

$$F_t(z) = \sum_{k=1}^{N} G_{k,t} \cdot H_k(z) \tag{9}$$

The echo canceler 600 synthesize the estimated synthetic transfer functions $F'_t(z)$ approximated to the echo path characteristics $F_t(z)$. That is, if an acoustic echo is conveyed within time t, the following equation is almost established:

$$F'_t(z)=F_t(z) \tag{10}$$

As described above, the estimated synthetic transfer function memories 740n store the estimated synthetic transfer functions $F'_t(z)$ to $F'_{t-N+1}(z)$ at the present moment (t) and the plurality of past moments (t–N+1) (FIG. 12(*c*)). Note that these estimated synthetic transfer functions may have impulse response forms.

In this case, when the position of speaker's mouth of the image 712 on the screen 710 moves from the block (i,j) to another block, an echo path characteristic F(z) which is different from the above echo path characteristics $F_t(z)$ is obtained. This new echo path is represented by $F_{t+1}(z)$.

The coefficient orthogonalization unit 760 orthogonalizes N sound image localization control transfer functions $G_{k,t}(z)$ to $G_{k,t-N+1}(z)$ of the sound image localization controllers $\mathbf{510}_k$ at the present moment (t) and the plurality of past moments (t–N+1) and N estimated synthetic transfer functions $F'_t(z)$ to $F'_{t-N+1}(z)$ at the present moment (t) and the plurality of past moments (t–N+1) to generate the estimated transfer functions $H'_k(z)$ corresponding to the transfer functions $H_k(z)$ between the microphone 101 and the loudspeakers $\mathbf{501}_k$. The estimated transfer functions $H'_k(z)$ are stored in the estimated transfer function memories $\mathbf{730}_k$ (FIGS. 12(*d*) and 12(*e*)).

When the above moving is performed, the coefficient orthogonalization unit 760 calculates products between the estimated transfer functions $H'_k(z)$ and a new sound image localization control transfer function $G_{k,t+1}(z)$ of the sound image localization controllers $\mathbf{510}_k$ for each transfer path, and synthesizes these products, thereby generating a new echo path characteristic $F_{t+1}$, i.e., a new estimated synthetic transfer function $F'_{t+1}(z)$ corresponding the new sound image localization control transfer function $G_{k,t+1}(z)$ (FIG. 12(*f*)).

The operation of the coefficient orthogonalization unit 760 as described above will be described in detail below.

In this case, when equation (9) is expressed by N transfer functions, the following equation can be obtained:

$$F_t(z)=G_t(z) \,.\, H(z) \tag{11}$$

where $F_t(z)=(F_t(z), F_{t-1}(z), \ldots, F_{t-N+1}(z))^T$ $H(z)=(H_1(z), H_2(z), \ldots, H_N(z))^T$ $$G_t(z) = G_{1,t}(z), G_{2,t}(z), \ldots, G_{N,t}(z) \begin{vmatrix} G_{2,t-1}(z), & \ldots, & G_{N,t-1}(z) \\ \ldots & \ldots \ \ldots & \ldots \\ G_{1,t-N+1}(z), & \ldots, & G_{N,t-N+1}(z) \end{vmatrix}$$

Similarly, estimated synthetic transfer functions are expressed as follows:

$$\hat{F}_t=G_t(z) \,.\, \hat{H}(z) \tag{12}$$

where $\hat{F}t(z)=(\hat{F}t(z), \hat{F}_{t-1}(z), \ldots, \hat{F}_{t-N+1}(z))^T$ $\hat{H}(z)=(\hat{H}_1(z), \hat{H}_2(z), \ldots, \hat{H}_N(z))^T$ In this case, equation (12) is rewritten into:

$$\hat{H}(z)=G_t^{-1}(z) \,.\, \hat{F}_t(z) \tag{13}$$

Therefore, if a set $F'_t$ of estimated synthetic transfer functions is obtained, a set H'(z) of estimated transfer functions which is not dependent on the sound image localization control transfer function $G_t(z)$ is obtained.

In this embodiment, the coefficient orthogonalization unit 760 performs the calculation of equation (13) (FIG. 12(*d*)). That is, the set H'(z) of the estimated transfer functions between the microphone 101 and the loudspeakers $\mathbf{501}_k$ is synthesized by the set $F'_t$ of the estimated synthetic transfer functions stored in the estimated synthetic transfer function memories $\mathbf{740}_n$ and the sound image localization control transfer function $G_t(z)$ stored in the sound image localization control information memories $\mathbf{750}_n$, and the set H'(z) is output and stored in the estimated transfer function memories $\mathbf{730}_k$ (FIG. 12(*e*)).

In this case, when the position of the speaker's mouth of the image 712 on the screen 710 moves from a certain block to another block, if it is considered that the unit time changes to (t+1), it can be understood that the sound image localization transfer function changes to $G_{k,t+1(z)}$.

In this embodiment, the coefficient orthogonalization unit 760 receives the estimated transfer functions $H'_k(z)$ stored in the estimated transfer function memories $\mathbf{730}_k$, the following calculation is performed:

$$F'_{t+1}(z) = \sum_{K=1}^{N} H'_k(z) \cdot G_{k,t+1}(z) \tag{14}$$

The coefficient orthogonalization unit 760 generates a new estimated synthetic transfer function $F'_{t+1}(z)$ corresponding to the new sound image localization control transfer functions $G_{k,t+1}(z)$ (FIG. 12(*f*)).

In the echo canceler 600, when the estimated synthetic transfer function $F'_{t+1}(z)$ newly generated is used as an initial value for an estimating operation, a decrease in cancel amount of an acoustic echo obtained when the position of speaker's mouth of the image 712 on the screen 710 moves from a certain block to another block, i.e., when the sound image localization transfer function changes, can be prevented.

Figure 13:
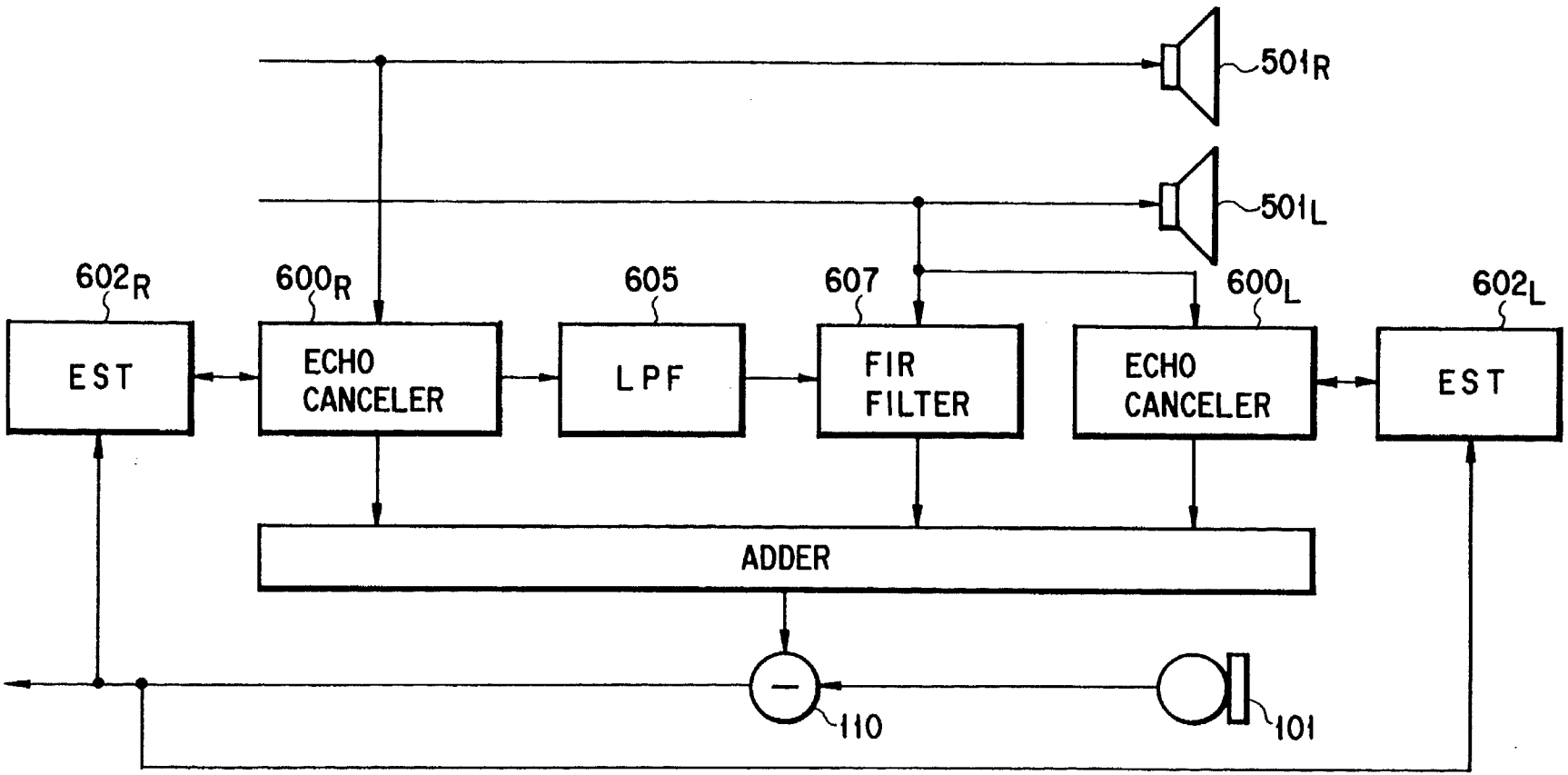
FIG. 13 is a block diagram showing the arrangement of a stereo voice echo canceler according to the fourth embodiment of the present invention.

FIG. 13 is a block diagram showing the arrangement of a stereo voice echo canceler according to the fourth embodiment of the present invention. Although FIG. 13 shows only a right-channel microphone, when the same stereo voice echo canceler as described above is used for a left-channel microphone, a stereo voice echo canceler for canceling echoes input from the right- and left-channel microphones can be realized.

Referring to FIG. 13, a right-channel echo canceler $\mathbf{600}_R$ estimates a right-channel pseudo echo on the basis of an input signal to a right-channel loudspeaker $\mathbf{501}_R$ and a right-channel echo path characteristic estimated by a right-channel echo path characteristic estimation processor $\mathbf{602}_R$. Only a low-frequency component is extracted from the estimated impulse response of the echo canceler $\mathbf{600}_R$ through a low-pass filter 605, and the low-frequency component is input to an FIR filter 607.

The FIR filter 607 generates a signal similar to a left-channel low-frequency pseudo echo on the basis of an input signal to a left loudspeaker $501_L$ using the right-channel estimated impulse response (only the low-frequency component) as a coefficient.

A left-channel echo canceler $600_L$ estimates a left-channel high-frequency pseudo echo of pseudo echoes on the basis of the input signal to the left-channel loudspeaker $501_L$ and a left-channel echo path characteristic estimation processor $602_L$.

Outputs from the right-channel echo canceler $600_R$, the FIR filter 607, and the left-channel echo canceler $600_L$ are input to an adder 608 and synthesized.

An output (left and right pseudo echoes) from the adder 608 is input to a subtracter 110.

The subtracter 110 subtracts pseudo echoes from an input signal input from a microphone 101.

Figure 14:
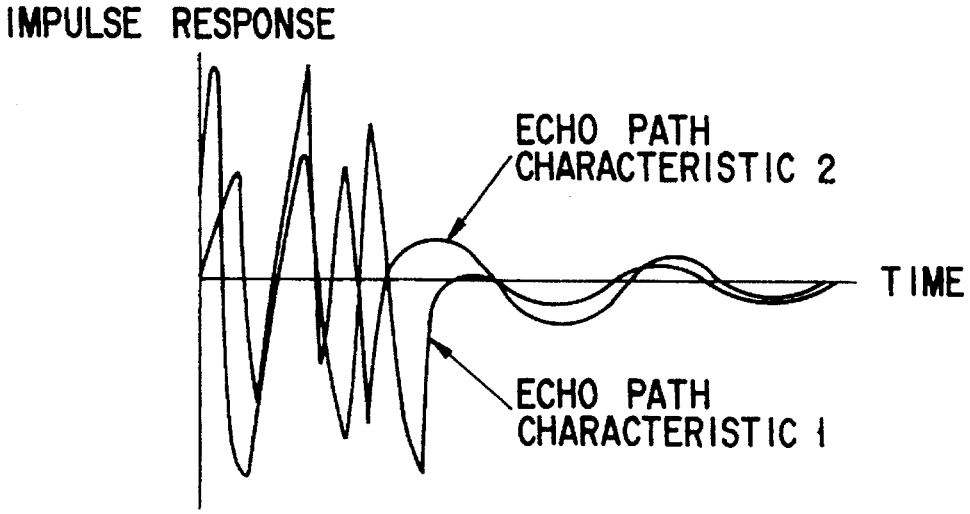
FIG. 14 is a graph showing the echo path characteristics of left and right loudspeakers.

In a normal state, left and right loudspeakers and microphones are arranged at relatively small intervals, e.g., 80 to 100 cm, in the same room. For this reason, it is considered that voices output from the left and right loudspeakers pass through echo paths having similar characteristics and are input to the microphones. In this case, the impulse response waveforms of two echo path characteristics input from the left and right loudspeakers to the microphones have a similarity as shown in FIG. 14. Since changes in impulse response of low-frequency components having longer wavelengths are decreased with respect to the position of the microphone, the low-frequency components having longer wavelengths have a higher similarity.

Therefore, according to this embodiment, it is considered that the left and right echo path characteristics have the similarity as described above, and the right-channel pseudo echo characteristic is used for a left-channel low-frequency pseudo echo. In this case, a processing amount of estimation and generation of a low-frequency echo which has a long impulse response and causes an increase in processing amount is reduced, thereby reducing the processing amount of a stereo voice echo canceler.

Figure 15:
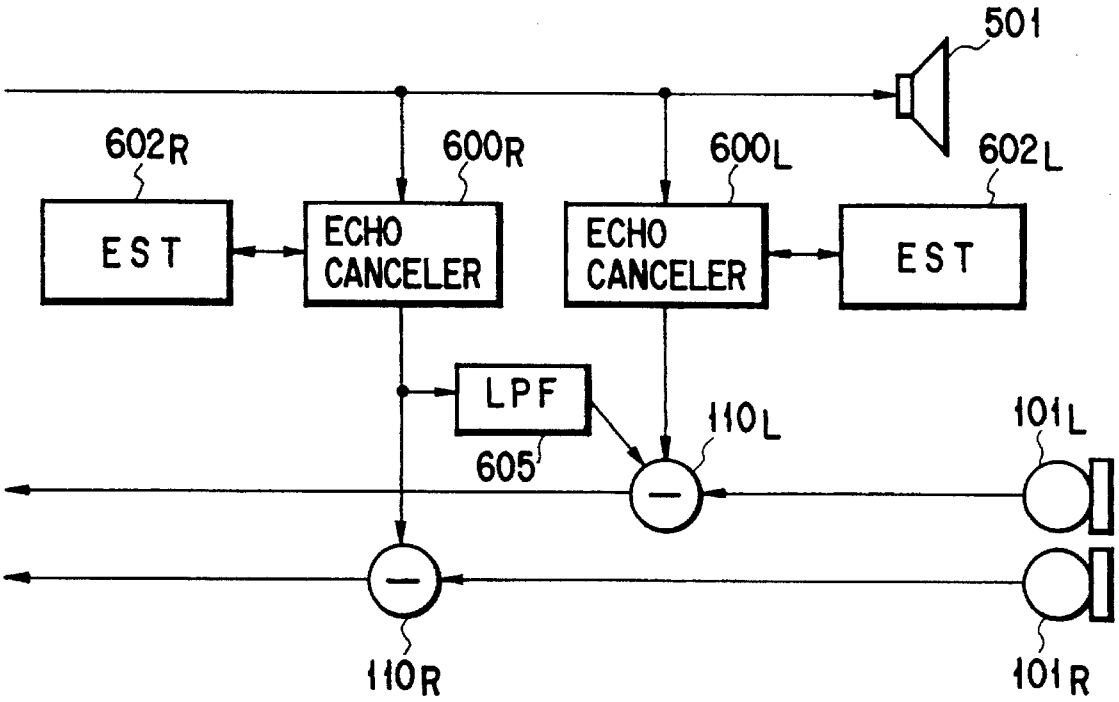
FIG. 15 is a block diagram showing the arrangement of a stereo echo canceler according to the fifth embodiment of the present invention.

FIG. 15 is a block diagram showing the arrangement of a stereo voice echo canceler according to the fifth embodiment of the present invention.

Referring to FIG. 15, a right-channel echo canceler $600_R$ estimates a right-channel pseudo echo on the basis of a right-channel echo path characteristic estimated by an input signal to the loudspeaker 501 and a right-channel echo path characteristic estimation processor $602_R$.

An output from the echo canceler $600_R$ is input to a subtracter 110R.

The subtracter 110R subtracts a pseudo echo from an input signal input from a right-channel microphone $101_R$.

A low-frequency component is extracted from the output from the echo canceler $600_R$ through a low-pass filter 605.

A left-channel echo canceler $600_L$ estimates a left-channel high-frequency pseudo echo of pseudo echoes on the basis of the input signal to the loudspeaker 501 and a left-channel high-frequency echo path characteristic estimated by a left-channel echo path characteristic estimation processor $602_L$.

Outputs from the low-pass filter 605 (LPF) and the left-channel echo canceler $600_L$ are input to a subtracter 110L.

The subtracter 110L subtracts a pseudo echo from an input signal input from a left-channel microphone $101_L$.

In this embodiment, as in the fourth embodiment, a processing amount of a stereo voice echo canceler can be greatly reduced.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A stereo signal coding/decoding apparatus for coding and decoding signals input from a plurality of input units, comprising:

discriminating means for discriminating a single utterance mode from a multiple simultaneous utterance mode;

first coding means for coding the signals when said discriminating means discriminates the single utterance mode;

first decoding means for decoding information coded by said first coding means;

a plurality of second coding means, arranged in correspondence with said plurality of input units, for coding the signals when said discriminating means discriminates the multiple simultaneous utterance mode; and a plurality of second decoding means, arranged in correspondence with said plurality of second coding means, for decoding pieces of information respectively coded by said plurality of second coding means.

2. An apparatus according to claim 1, wherein said first coding means includes means for coding the signals with respect to a band wider than that of said second coding means.

3. An apparatus according to claim 1, wherein said first coding means includes means for coding the signals at a rate equal to or more than a code output rate of said second coding means.

4. An apparatus according to claim 1, wherein said first coding means and said plurality of second coding means respectively include means for variably changing code output rates.

5. An apparatus according to claim 1, wherein said first coding means includes means for coding main information consisting of a signal of at least one of said plurality of input units and means for coding the signals with respect to a band wider than that of said second coding means.

6. An apparatus according to claim 5, wherein said first coding means includes means for coding the signals with respect to a band wider than that of said second coding means.

7. An apparatus according to claim 5, wherein said first coding means includes means for coding the signals at a rate equal to or more than a code output rate of said second coding means.

8. An apparatus according to claim 5, wherein said first coding means and said plurality of second coding means respectively include means for variably changing code output rates.

9. An apparatus according to claim 5, wherein said first coding means includes means for performing coding of the main information at a rate higher than that of coding of each of said plurality of second coding means.

10. An apparatus according to claim 1, wherein said plurality of second coding means include means for respectively coding signals output from said plurality of input units corresponding to said plurality of second coding means.

11. An apparatus according to claim 10, wherein said first coding means includes means for coding the signals with respect to a band wider than that of said second coding means.

12. An apparatus according to claim 10, wherein said first coding means includes means for coding the signals at a rate equal to or more than a code output rate of said second coding means.

13. An apparatus according to claim 10, wherein said first coding means and said plurality of second coding means respectively include means for variably changing code output rates.

14. An apparatus according to claim 1, further comprising selecting means for selecting coded main information and coded additional information in a single utterance mode and the pieces of coded information in a multiple simultaneous utterance mode.

15. An apparatus according to claim 1, further comprising selecting means for selecting decoded main information and decoded additional information in a single utterance mode and the pieces of decoded information in a multiple simultaneous utterance mode.

16. An apparatus according to claim 1, wherein said discriminating means further includes:

means for calculating a delay time between a signal from at least one of said plurality of input units and a signal from a remaining one of said plurality of input units every predetermined time interval; and means for discriminating the multiple simultaneous utterance when the delay time is absent within the predetermined time interval and discriminating the single utterance mode when the delay time is present within the predetermined time interval.

17. An apparatus according to claim 1, further comprising:

a plurality of audible sound output units for outputting a plurality of audible sounds obtained such that sound image localization control of an input signal is performed on the basis of a plurality of pieces of sound image localization control information using at least one of a delay difference, a phase difference, and a gain difference as information, and for forming sound image localization by using the sound image localization control information;

an audible sound input unit for inputting an audible sound; and an echo canceler for estimating acoustic echoes input from said plurality of audible sound output units to said audible sound input unit, on the basis of estimated synthetic echo path characteristics between said plurality of audible sound output units and said audible sound input unit, and for subtracting the acoustic echoes from an audible sound input to said audible sound input unit.

18. An apparatus according to claim 17, wherein said echo canceler includes:

estimating means for estimating respective acoustic transfer characteristics between said plurality of audible sound output units and said audible sound input unit on the basis of present sound image localization control information, past sound image localization control information, a present estimated synthetic echo path characteristic, and a past estimated synthetic echo path characteristic; and generating means for, when the position of the image displayed on the screen changes, generating a new estimated synthetic echo path characteristic on the basis of the new sound image localization control information and the new acoustic transfer characteristics which correspond to the change in position.

19. An apparatus according to claim 18, wherein said estimating means includes means for estimating the respective acoustic transfer characteristics between said plurality of audible sound output units and said audible sound input unit by linear arithmetic processing between the present sound image localization control information, the past sound image localization control information, the present estimated synthetic echo path characteristic, and the past estimated synthetic echo path characteristic.

20. An apparatus according to claim 19, wherein said estimating means includes means for performing the linear arithmetic processing by performing multiplication between an inverse matrix of a matrix having the present sound image localization control information and the past sound image localization control information as elements and a matrix having the present estimated synthetic echo path characteristic and the past estimated synthetic echo path characteristic as elements.

21. An apparatus according to claim 17, wherein said echo canceler includes:

estimating means for estimating a first pseudo echo path characteristic corresponding to at least one of the plurality of echo paths from the echo path characteristics of the plurality of echo paths;

generating means for generating a second pseudo echo path characteristic corresponding to at least one echo path except for the echo path for the first pseudo echo path characteristic which is estimated by said estimating means, using the first pseudo echo path characteristic estimated by said estimating means; and synthesizing means for synthesizing the first and second pseudo echo path characteristics corresponding to the plurality of echo paths.

22. An apparatus according to claim 21, wherein said generating means includes means for generating a low-frequency component on the basis of the first pseudo echo path characteristic and generating a high-frequency component on the basis of a pseudo echo path characteristic of an echo path corresponding to the second pseudo echo characteristic.

23. A stereo signal coding/decoding apparatus having coding means for coding signals from a plurality of input units and decoding means for decoding the signals coded by said coding means, wherein said coding means includes first coding means for coding main information consisting of a signal from at least one of said plurality of input units and additional information required to synthesize a signal from a remaining one of said plurality of input units in accordance with the main information;

a plurality of second coding means for coding individual signals from said plurality of input units;

discriminating means for discriminating a single utterance mode from a multiple simultaneous utterance mode on the basis of the signals from said plurality of input units; and selecting means for selecting the coded main information and the coded additional information in a single utterance mode and the individually coded signals in a multiple simultaneous utterance mode.

24. A stereo signal coding/decoding apparatus having coding means for coding signals from a plurality of input units and decoding means for decoding the signals coded by said coding means, wherein said decoding means includes first decoding means for decoding main information consisting of a signal from at least one of said plurality of input units and additional information required to synthesize a signal from a remaining one of said plurality of input units in accordance with the main information;

a plurality of second decoding means for decoding individual signals from said plurality of input means;

discriminating means for discriminating a single utterance mode from a multiple simultaneous utterance mode on the basis of the additional information; and selecting means for selecting the decoded main information and the decoded additional information in a single utterance mode and the individually decoded signals in a multiple simultaneous utterance mode.

25. A stereo signal coding/decoding apparatus comprising:

coding means for coding signals from a plurality of input units;

decoding means for decoding the signals coded by said coding means; and discriminating means for discriminating a single utterance mode from a multiple simultaneous utterance mode, wherein said discriminating means includes means for calculating a delay time between a signal from at least one of said plurality of input units and a signal from a remaining one of said plurality of input units every predetermined time interval, and means for discriminating the multiple simultaneous utterance mode when the delay time is absent within the predetermined time interval and discriminating the single utterance mode when the delay time is present within the predetermined time interval.

26. An echo canceler, applied to an input apparatus including a plurality of audible sound output units for outputting a plurality of audible sounds obtained such that sound image localization control of an input monaural signal is performed on the basis of a plurality of pieces of sound image localization control information using at least one of a delay difference, a phase difference, and a gain difference as information, and for forming sound image localization at a position corresponding to a position of an image displayed on display means and an audible sound input unit for inputting an audible sound, for estimating acoustic echoes input from said plurality of audible sound output units to said audible sound input unit, on the basis of estimated synthetic echo path characteristics between said plurality of audible sound output units and said audible sound input unit, and for subtracting the acoustic echoes from an audible sound input to said audible sound input unit, comprising:

estimating means for estimating respective acoustic transfer characteristics between said plurality of audible sound output units and said audible sound input unit on the basis of present sound image localization control information, past sound image localization control information, a present estimated synthetic echo path characteristic, and a past estimated synthetic echo path characteristic; and generating means for, when the position of the image displayed on the screen changes, generating a new estimated synthetic echo path characteristic on the basis of the new sound image localization control information and the new acoustic transfer characteristics which correspond to the change in position.

27. An apparatus according to claim 26, wherein said estimating means includes means for estimating the respective acoustic transfer characteristics between said plurality of audible sound output units and said audible sound input unit by linear arithmetic processing between the present sound image localization control information, the past sound image localization control information, the present estimated synthetic echo path characteristic, and the past estimated synthetic echo path characteristic.

28. An apparatus according to claim 27, wherein said estimating means includes means for performing the linear arithmetic processing by performing multiplication between an inverse matrix of a matrix having the present sound image localization control information and the past sound image localization control information as elements and a matrix having the present estimated synthetic echo path characteristic and the past estimated synthetic echo path characteristic as elements.

29. An input/output apparatus comprising:

sound image localization control information generating means for generating a plurality of pieces of sound image localization control information using, as information, at least one of a delay difference, a phase difference, and a gain difference which are determined in correspondence with a position of an image displayed on a screen;

a plurality of control means for giving at least one of the delay difference, the phase difference, and the gain difference to an input monaural signal in accordance with a sound image localization control transfer function based on the sound image localization control information generated by said sound image localization control information generating means;

a plurality of audible sound output means for outputting audible sounds corresponding to the signals output from said plurality of signal control means;

an audible sound input unit for inputting an audible sound;

echo estimating means for estimating acoustic echoes input from said plurality of audible sound output means to said audible sound input unit, on the basis of estimated synthetic transfer functions between said audible sound input and said plurality of audible sound output means;

subtracting means for subtracting the echoes estimated by said echo estimating means from the audible sound input from said audible sound input unit;

first storage means for storing present and past sound image localization control transfer functions;

second storage means for storing present and past estimated synthetic transfer functions;

transfer function estimating means for estimating transfer functions between said plurality of audible sound output means and said audible sound input unit on the basis of the sound image localization control transfer functions stored in said first storage means and the estimated synthetic transfer functions stored in said second storage means;

third storage means for estimating the transfer functions estimated by said transfer function estimating means; and synthetic transfer function generating means for, when the position of the image displayed on said screen changes, generating a new estimated synthetic transfer function on the basis of a new sound image localization control transfer function and the estimated transfer functions stored in said third storage means, all of which correspond to the change in position.

30. An apparatus according to claim 29, wherein said transfer function estimating means includes means for estimating the respective acoustic transfer functions between said plurality of audible sound output means and said audible sound input unit by linear arithmetic processing between the present sound image localization control information, the past sound image localization control information, the present estimated synthetic echo path characteristic, and the past estimated synthetic echo path characteristic.

31. An apparatus according to claim 30, wherein said transfer function estimating means includes means for performing the linear arithmetic processing by performing multiplication between an inverse matrix of a matrix having the present sound image localization control information and the past sound image localization control information as elements and a matrix having the present estimated synthetic echo path characteristic and the past estimated synthetic echo path characteristic as elements.

32. An echo canceler comprising:

estimating means for estimating a first pseudo echo path characteristic corresponding to at least one of a plurality of echo paths from echo path characteristics of the plurality of echo paths;

generating means for generating a second pseudo echo path characteristic corresponding to at least one echo path except for the echo path corresponding to the first pseudo echo path characteristic estimated by said estimating means, using the first pseudo echo path characteristic estimate by said estimating means; and synthesizing means for synthesizing the first and second pseudo echo path characteristics corresponding to the plurality of echo paths.

33. A canceler according to claim 32, wherein said generating means includes means for generating a low-frequency component on the basis of the first pseudo echo path characteristic and generating a high-frequency component on the basis of a pseudo echo path characteristic of an echo path corresponding to the second pseudo echo characteristic.

34. An input/output apparatus comprising:

display means for displaying an image from a generating source for generating the signals;

a plurality of audible sound output units for outputting a plurality of audible sounds obtained such that sound image localization control of an input signal is performed on the basis of a plurality of pieces of sound image localization control information using at least one of a delay difference, a phase difference, and a gain difference as information, and for forming sound image localization at a position corresponding to a position of an image displayed on said display means;

an audible sound input unit for inputting an audible sound; and an echo canceler for estimating acoustic echoes input from said plurality of audible sound output units so said audible sound input unit, on the basis of estimated synthetic echo path characteristics between said plurality of audible sound output units and said audible sound input unit, and for subtracting the acoustic echoes from an audible sound input to said audible sound input unit.

35. An apparatus according to claim 34, wherein said echo canceler includes:

estimating means for estimating respective acoustic transfer characteristics between said plurality of audible sound output units and said audible sound input unit on the basis of present sound image localization control information, past sound image localization control information, a present estimated synthetic echo path characteristic, and a past estimated synthetic echo path characteristic; and generating means for, when the position of the image displayed on the screen changes, generating a new estimated synthetic echo path characteristic on the basis of the new sound image localization control information and the new acoustic transfer characteristics which correspond to the change in position.

36. An apparatus according to claim 35, wherein said estimating means includes means for estimating the respective acoustic transfer characteristics between said plurality of audible sound output units and said audible sound input unit by linear arithmetic processing between the present sound image localization control information, the past sound image localization control information, the present estimated synthetic echo path characteristic, and the past estimated synthetic echo path characteristic.

37. An apparatus according to claim 36, wherein said estimating means includes means for performing the linear arithmetic processing by performing multiplication between an inverse matrix of a matrix having the present sound image localization control information and the past sound image localization control information as elements and a matrix having the present estimated synthetic echo path characteristic and the past estimated synthetic echo path characteristic as elements.

38. An apparatus according to claim 34, wherein said echo canceler includes:

estimating means for estimating a first pseudo echo path characteristic corresponding to at least one of the plurality of echo paths from the echo path characteristics of the plurality of echo paths;

generating means for generating a second pseudo echo path characteristic corresponding to at least one echo path except for the echo path for the first pseudo echo path characteristic which is estimated by said estimating means, using the first pseudo echo path characteristic estimated by said estimating means; and synthesizing means for synthesizing the first and second pseudo echo path characteristics corresponding to the plurality of echo paths.

39. An echo canceler comprising:

estimating means for estimating a first pseudo echo signal corresponding to at least one of a plurality of echo paths from echo path characteristics of the plurality of echo paths;

generating means for generating a second pseudo echo signal corresponding to at least one echo path except for the echo path corresponding to the first pseudo echo signal estimated by said estimating means, using the first pseudo echo signal estimate by said estimating means; and synthesizing means for synthesizing the first and second pseudo echo signals corresponding to the plurality of echo paths.

40. A canceler according to claim 39, wherein said generating means includes means for generating a low-frequency component on the basis of the first pseudo echo signals and generating a high-frequency component on the basis of a pseudo echo signal of an echo path corresponding to the second pseudo echo signal.

41. An echo canceler, applied to an input apparatus including a plurality of audible sound output units for outputting a plurality of audible sounds obtained such that sound image localization control of an input monaural signal is performed on the basis of a plurality of pieces of sound image localization control information using at least one of a delay difference, a phase difference, and a gain difference as information, and for forming sound image localization at a position corresponding to the sound image localization control information and an audible sound input unit for inputting an audible sound, for estimating acoustic echoes input from said plurality of audible sound output units to said audible sound input unit, on the basis of estimated synthetic echo path characteristics between said plurality of audible sound output units and said audible sound input unit, and for subtracting the acoustic echoes from an audible sound input to said audible sound input unit, comprising:

estimating means for estimating respective acoustic transfer characteristics between said plurality of audible sound output units and said audible sound input unit on the basis of present sound image localization control information, past sound image localization control information, a present estimated synthetic echo path characteristic, and a past estimated synthetic echo path characteristic; and generating means for, when the sound image localization changes, generating a new estimated synthetic echo path characteristic on the basis of the new sound image localization control information and the new acoustic transfer characteristics which correspond to the sound image localization change.

42. An apparatus according to claim 41, wherein said estimating means includes means for estimating the respective acoustic transfer characteristics between said plurality of audible sound output units and said audible sound input unit by linear arithmetic processing between the present sound image localization control information, the past sound image localization control information, the present estimated synthetic echo path characteristic, and the past estimated synthetic echo path characteristic.

43. An apparatus according to claim 41, wherein said estimating means includes means for performing the linear arithmetic processing by performing multiplication between an inverse matrix of a matrix having the present sound image localization control information and the past sound image localization control information as elements and a matrix having the present estimated synthetic echo path characteristic and the past estimated synthetic echo path characteristic as elements.

* * * * *